US007613422B2

(12) United States Patent
Shida et al.

(10) Patent No.: US 7,613,422 B2
(45) Date of Patent: Nov. 3, 2009

(54) IMAGE FORMING APPARATUS AND INTERMEDIATE CONVEYANCE UNIT

(75) Inventors: Toshio Shida, Higashiyamato (JP); Masaaki Uchiyama, Hachioji (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 332 days.

(21) Appl. No.: 11/501,526

(22) Filed: Aug. 9, 2006

(65) Prior Publication Data

US 2007/0102861 A1 May 10, 2007

(30) Foreign Application Priority Data

Nov. 9, 2005 (JP) ..... 2005-324588
Nov. 15, 2005 (JP) ..... 2005-329936

(51) Int. Cl.
*G03G 15/00* (2006.01)

(52) U.S. Cl. ..... 399/407; 399/402; 399/408; 270/37; 270/59

(58) Field of Classification Search ..... 399/408, 399/402, 407; 270/37, 59
See application file for complete search history.

(56) References Cited

U.S. PATENT DOCUMENTS 4,582,421 A * 4/1986 Hamlin et al. ..... 355/72
5,010,363 A * 4/1991 Higashio et al. ..... 399/19
5,028,965 A * 7/1991 Kinoshita et al. ..... 399/402
5,037,083 A 8/1991 Johdai et al.
5,140,380 A * 8/1992 Nakamura et al. ..... 399/408
5,569,012 A * 10/1996 Kosasa et al. ..... 412/33
5,746,162 A 5/1998 Hosoi et al.
6,000,894 A * 12/1999 Suzuki et al. ..... 412/11
6,076,817 A * 6/2000 Kobayashi et al. ..... 270/58.09
6,213,456 B1 * 4/2001 Hirano et al. ..... 270/58.08
6,220,592 B1 * 4/2001 Watanabe et al. ..... 271/241
6,575,446 B2 * 6/2003 Wakabayashi et al. ... 270/58.07
6,641,129 B2 * 11/2003 Ogita et al. ..... 270/58.08
7,120,384 B2 * 10/2006 Kenji et al. ..... 399/408
7,201,368 B2 * 4/2007 Tanigami et al. ..... 270/58.11
7,284,752 B2 * 10/2007 Nagata et al. ..... 270/58.18
7,328,892 B2 * 2/2008 Asami et al. ..... 270/37

(Continued)

FOREIGN PATENT DOCUMENTS

JP 06211414 A * 8/1994

(Continued)

*Primary Examiner*—Judy Nguyen
*Assistant Examiner*—Andy L Pham
(74) *Attorney, Agent, or Firm*—Frishauf, Holtz, Goodman & Chick, P.C.

(57) ABSTRACT

An image forming apparatus having therein an image forming apparatus body and at least one post-processing apparatus, wherein there is provided an intermediate conveyance unit which is connected with and located between the image forming apparatus body and the post-processing apparatus and which has a sheet feed-in section that feeds in sheets ejected from the image forming apparatus body one by one at the same speed as the sheet ejection linear speed of the image forming apparatus body, a sheet storing section that stores two or more sheets which are fed in by the sheet feed-in section and a sheet feed-out section that feeds out the two or more sheets stored in the sheet-storing section with the two or more sheets superposed on each other, at the same speed as the receiving linear speed of the post-processing apparatus.

14 Claims, 19 Drawing Sheets

U.S. PATENT DOCUMENTS

| | | | | |
|---|---|---|---|---|
| 2002/0163120 | A1* | 11/2002 | Yamada et al. | 271/221 |
| 2004/0207142 | A1 | 10/2004 | Sasa et al. | |
| 2005/0121847 | A1 | 6/2005 | Anzai et al. | |
| 2006/0013629 | A1* | 1/2006 | Kenji et al. | 399/408 |
| 2007/0102861 | A1* | 5/2007 | Shida et al. | 270/59 |

FOREIGN PATENT DOCUMENTS

| | | | | |
|---|---|---|---|---|
| JP | 06211415 | A | * | 8/1994 |
| JP | 07179262 | A | * | 7/1995 |
| JP | 08-020106 | A | | 1/1996 |
| JP | 2000-224380 | A | | 8/2000 |
| JP | 2002-128384 | A | | 5/2002 |
| JP | 2003206068 | A | * | 7/2003 |
| JP | 2004-106976 | A | | 4/2004 |
| JP | 2005-015225 | A | | 1/2005 |
| JP | 2005335881 | A | * | 12/2005 |
| JP | 2007090773 | A | * | 4/2007 |

* cited by examiner

IMAGE FORMING APPARATUS AND INTERMEDIATE CONVEYANCE UNIT

This application is based on Japanese Patent Application No. 2005-324588 filed on Nov. 9, 2005 and No. 2005-329936 filed on Nov. 15, 2005 in Japanese Patent Office, the entire content of which is hereby incorporated by reference.

BACKGROUND OF THE INVENTION

The present invention relates to an image forming apparatus wherein various post-processing operations can be carried out by a sheet post-processing apparatus for a sheet on which recording has been conducted by an image forming apparatus body, to an intermediate conveyance unit that is located between the image forming apparatus body and the sheet post-processing apparatus to be connected to both of them, and to an image forming method.

In Patent Document 1, there has been disclosed an image forming apparatus wherein various types of post-processing apparatuses having functions to conduct hole-punching processing, stitching processing, folding processing and bookbinding processing for a sheet after recording can be mounted on a copying machine serving as an image forming apparatus body.

An image forming apparatus shown in Patent Document 2 is one wherein a common single-sheet processing unit is arranged between an image forming apparatus body and at least one type of post-processing apparatus among plural types of post-processing apparatuses.

In the case of the image forming apparatus described in Patent Document 1, the apparatus is constructed so that various types of post-processing functions may be handled by a single post-processing apparatus. Therefore, the image forming apparatus is effective when it is installed in the environment where various users use the apparatus in many ways, as in an office, for example. Since the post-processing apparatus of this kind is relatively small in size, it is also effective on that point for an office where space-saving is required.

When using as an image forming apparatus for such as quick printing, for example, an image forming apparatus that satisfies all post-processing functions is not always needed, and an apparatus having capability to satisfy only-specific post-processing function sufficiently is required. Namely, when using an image forming apparatus for such as quick printing, the frequency for a specific user to use specific post-processing function is higher than that for various users to use in many ways as in an office.

In the aforesaid image forming apparatus, a single relatively-compact post-processing apparatus has various post-processing functions and it deals with various usage types. However, when focusing attention on individual post-processing function, it is rather difficult to assure that the individual post-processing is at sufficient level functionally. For example, when using an image forming apparatus as an image forming apparatus for quick printing, the required level is higher than that of post-processing requested on an image forming apparatus used in the office, and the actual level is still lower than the level satisfying sufficiently the demands in the quick printing.

In recent years, an image forming apparatus of an electrophotographic system has come to be used in the field of quick printing. Namely, book binding on a print-on-demand system of "making prints in necessary quantity of copies only when needed" is possible, by using an image forming apparatus equipped with the post-processing apparatus stated above.

In addition, no labor hour is needed for plate making which has been carried out in the conventional printing, and enhancement of efficiency and cost reduction for bookbinding work are greatly expected.

The image forming apparatus shown in Patent Document 2 is an apparatus satisfying the aforesaid demands, and it is an image forming apparatus having the structure wherein a single sheet processing unit representing one type of post-processing apparatus is connected on the sheet ejection side of the image forming apparatus body, and further, at least one type of post-processing apparatus among plural types of post-processing apparatuses is connected to the single sheet processing apparatus.

(Patent Document 1) Unexamined Japanese Patent Application Publication No. 2002-128384

(Patent Document 2) Unexamined Japanese Patent Application Publication No. 2005-15225

SUMMARY

Structures of the invention are as follow.

Structure 1

An image forming apparatus having therein an image forming apparatus body and at least one post-processing apparatus, wherein there is provided an intermediate conveyance unit which is connected with and located between the image forming apparatus body and the post-processing apparatus and which has a sheet feed-in section that feeds in sheets ejected from the image forming apparatus body one by one at the same speed as the sheet ejection linear speed of the image forming apparatus body, a sheet storing section that stores two or more sheets which are fed in by the sheet feed-in section and a sheet feed-out section that feeds out the two or more sheets stored in the sheet storing section with the two or more sheets superposed on each other, at the same speed as the receiving linear speed of the post-processing apparatus.

Structure 2

An intermediate conveyance unit connected with and located between an image forming apparatus body and a post-processing apparatus, wherein there are provided a sheet feed-in section that feeds in the sheets ejected from the image forming apparatus body one by one at the same speed as the sheet ejection linear speed of the image forming apparatus body, a sheet storing section that stores two or more sheets which are fed in by the sheet feed-in section and a sheet feed-out section that feeds out the two or more sheets stored in the sheet storing section with the two or more sheets superposed on each other, at the same speed as the receiving linear speed of the post-processing apparatus.

DETAILED DESCRIPTION OF THE PREFERRED EMBODIMENT

The invention will be explained as follow, referring to the accompanying drawings, and the explanations in these columns are not limited to the technical scope or meanings of the terminologies in the aforementioned Structures.

An image forming apparatus of the invention will be explained based on the drawings.

Figure 1:
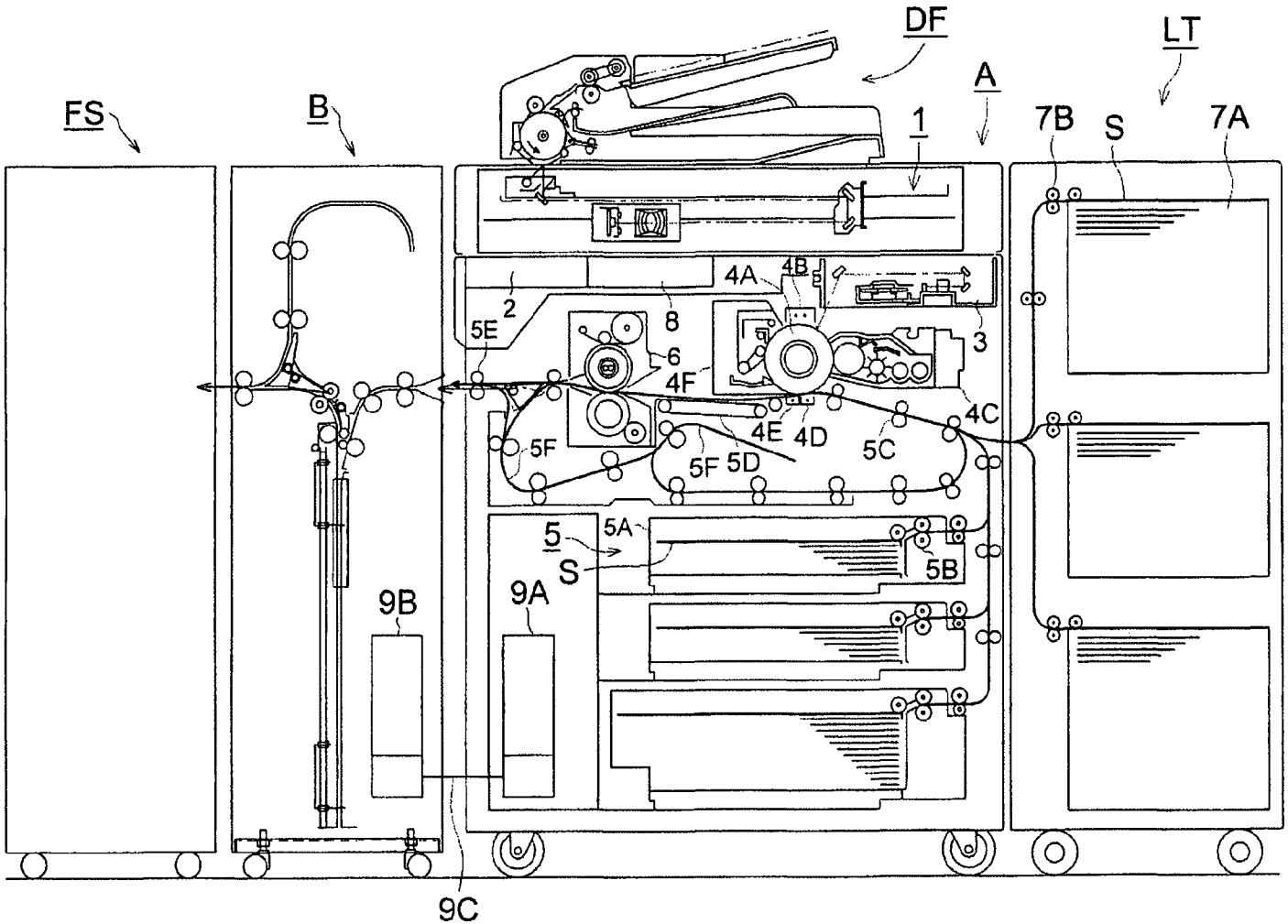
FIG. 1 shows a total structural diagram of the image forming apparatus composed of an image forming apparatus body, an automatic document feeding device, a large capacity sheet supply apparatus, an intermediate conveyance unit and a post-processing apparatus.

FIG. 1 shows a total structural diagram of the image forming apparatus composed of image forming apparatus body A, automatic document feeding device DF, large capacity sheet supply apparatus LT, intermediate conveyance unit B and post-processing apparatus FS.

(Image Forming Apparatus Body)

Image forming apparatus body A illustrated is equipped with image reading section 1, image processing section 2, image writing section 3, image forming section 4, sheet supply conveyance section 5 and with fixing unit 6.

The image forming section 4 is composed of photoreceptor drum 4A, charging section 4B, developing section 4C, transfer section 4D, separation section 4E and cleaning section 4F and the like.

The sheet supply conveyance section 5 is equipped with sheet supply cassette 5A, first sheet supply section 5B, second sheet supply section 5C, conveyance section 5D, sheet ejection section 5E and with automatic duplexing copying sheet supply unit (ADU) 5F.

Operation display section 8 composed of an inputting section and a display section is arranged on the front side of the upper part of image forming apparatus body A. On the upper part of the image forming apparatus body A, there is installed automatic document feeding unit DF. Intermediate conveyance unit B is connected to the left side of the illustrated image forming apparatus body A where sheet ejection section 5E is present, and post-processing apparatus FS is connected to the left side of the intermediate conveyance unit B.

Images on one side or on both sides of the document placed on an document table of automatic document feeding unit DF are read by an optical system of image reading section 1, and then, are converted photoelectrically into analogue signals which are sent to image writing section 3 after being subjected to processing such as analogue processing in image processing section 2, A/D conversion, shading correction, image compression processing and the like.

In image writing section 3, photoreceptor drum 4A of image forming section 4 is exposed to light emitted from a semiconductor laser, to form thereon a latent image. In the image forming section 4, operations including charging, exposure, developing, transfer, separation and cleaning are carried out.

Sheet S fed by the first sheet supply section 5B is subjected to transferring of images conducted by transfer section 4D. The sheet S carrying images is fixed by fixing unit 6, and is fed into intermediate conveyance unit B from sheet ejection section 5E. Or the sheet S having been image-processed on one side is fed into automatic duplexing copying sheet supply unit 5F and ejected by sheet ejection section 5E to be sent into intermediate conveyance unit B after two-sided image processing by image forming section 4.

A communication section of control section 9A arranged in image forming apparatus body A and a communication section of control section 9B arranged in intermediate conveyance unit B are connected to each other by communication line 9C, to give and receive input signals and control signals.

(Large Capacity Sheet Supply Apparatus)

Large capacity sheet supply apparatus LT is composed of sheet stacking section 7A, first sheet supply section 7B and the like, and it supplies a large amount of sheets S continuously, to feed them into image forming apparatus body A.

In the mean time, it is also possible to connect the large capacity sheet supply apparatus LT to intermediate conveyance unit B to feed a large amount of printed sheets S housed in the large capacity sheet supply apparatus LT directly into intermediate conveyance unit B.

(Intermediate Conveyance Unit)

Figure 2:
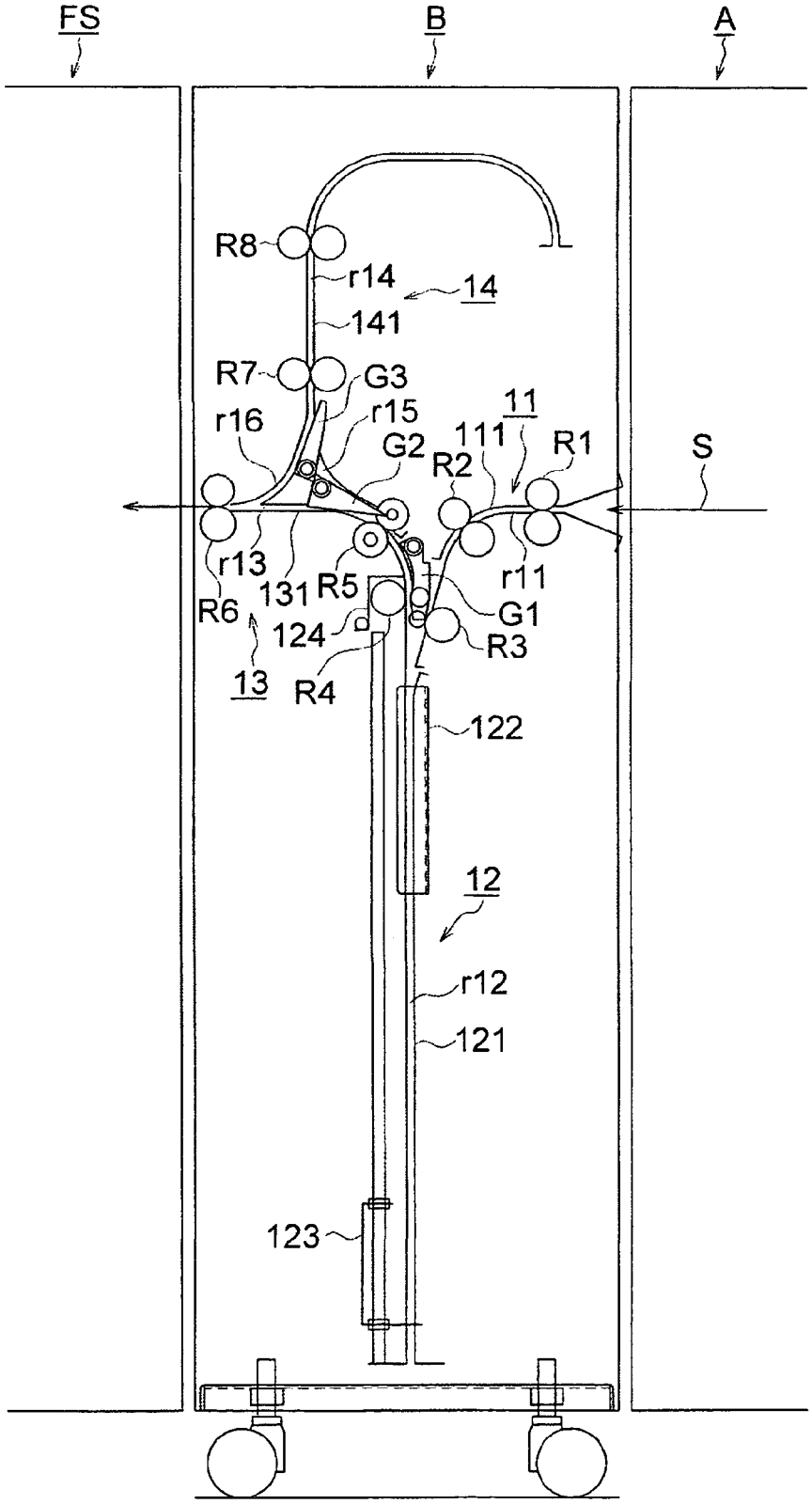
FIG. 2 is a front sectional view of an intermediate conveyance unit.

FIG. 2 is a front sectional view of intermediate conveyance unit B.

A sheet conveyance section of the intermediate conveyance unit B is equipped with sheet feed-in section (first conveyance section) 11, sheet storing section (second conveyance section) 12, sheet feed-out section (third conveyance section) 13 and sheet reversing section (fourth conveyance section) 14.

Sheet feed-in section 11 is equipped with sheet conveyance path r11 composed of conveyance rollers R1 and R2 and of guide plate 111. In the sheet feed-in section 11, sheets S ejected from sheet ejection section 5E of image forming apparatus body A are accepted sequentially to be conveyed.

Sheet storing section 12 is equipped with a longitudinal alignment mechanism having therein two guide plates 121 arranged to be in parallel, lateral alignment mechanism 122, stop member 123 and longitudinal alignment plate 124, and further with feed-in drive roller R3, feed-out drive roller R4 and with sheet conveyance path r12. In the sheet storing section 12, plural sheets S accepted from the sheet feed-in section 11 are stored and aligned with they superposed on each other, and then, are ejected upward.

The sheet feed-out section 13 is equipped with sheet conveyance path r13 having therein intermediate conveyance rollers R5, sheet ejection rollers R6 and guide plate 131. In the sheet feed-out section 13, plural sheets S stored in the sheet storing section 12 are reversed and conveyed in the state where they are superposed, and then, are fed into the succeeding post-processing apparatus FS.

Sheet reversing section 14 is equipped with sheet conveyance path r14 having therein conveyance rollers R7 and R8 and guide plate 141. In the sheet reversing section 14, plural sheets S stored in the sheet storing section 12 pass through upper sheet conveyance path r15, then, switchback on sheet conveyance path r14 to be reversed again, and pass through lower sheet conveyance path r16 to be ejected, and are fed into the succeeding post-processing apparatus FS.

On the upper part of the sheet storing section 12, there is arranged conveyance path switching member G1 which switches between introduction of sheet S into the sheet storing section 12 and ejection of sheet S from the sheet storing section 12.

Conveyance path switching member G2 arranged in sheet feed-out section 13 causes sheet S conveyed from the sheet storing section 12 to branch to either one of sheet conveyance path r13 for conveying the sheet to sheet ejection rollers R6 along guide plate 131 and sheet conveyance path r15 for conveying the sheet to sheet reversing section 14.

Conveyance path switching member G3 arranged on the lower part of sheet reversing section 14 switches between sheet conveyance path r15 opened by conveyance path switching member G2 and sheet conveyance path r16 for ejecting sheet S from sheet reversing section 14. Each of conveyance path switching members G1, G2 and G3 is connected to a solenoid to be driven.

Figure 3:
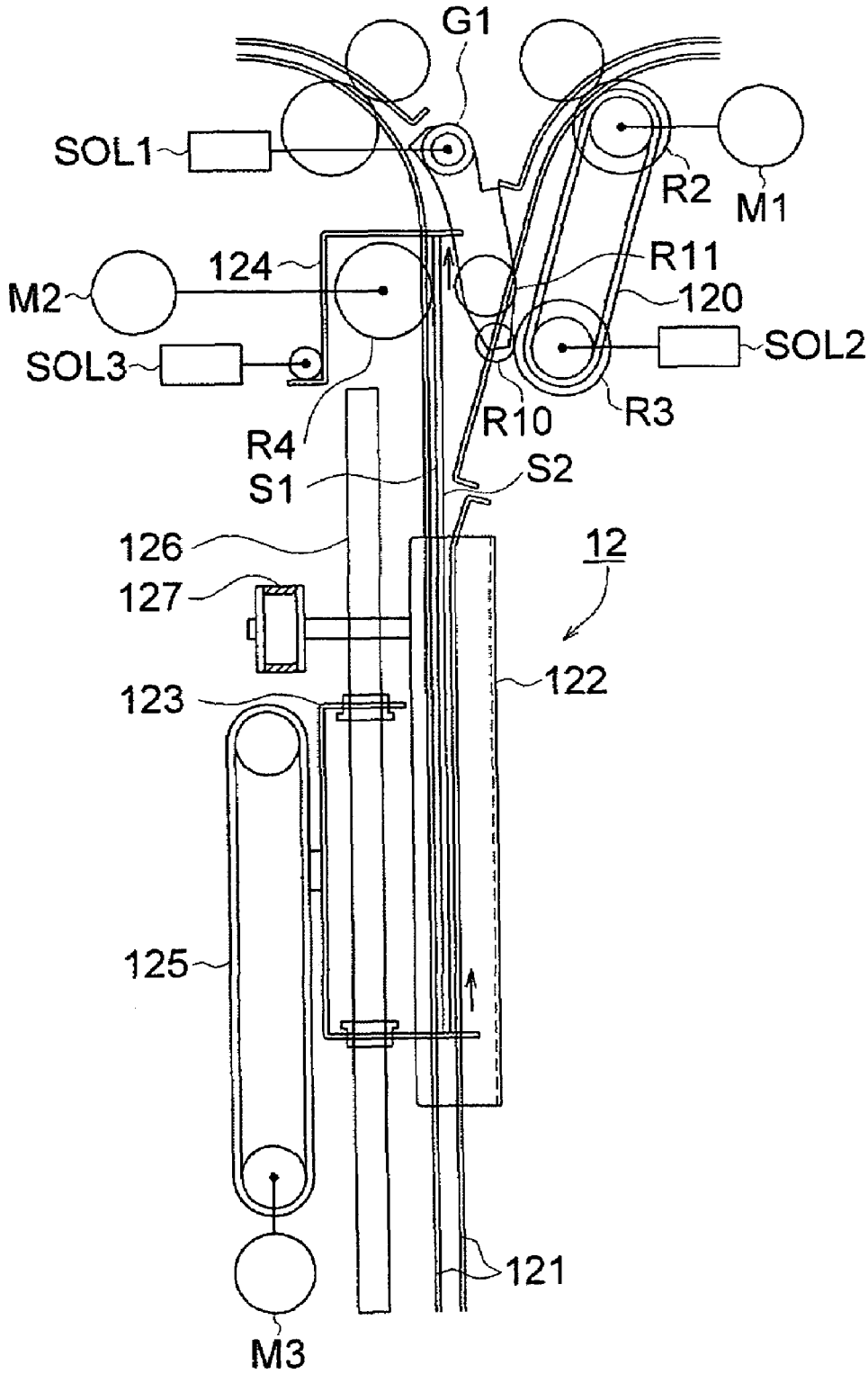
FIG. 3 is a sectional view showing a drive section for an intermediate conveyance unit.

FIG. 3 is a sectional view showing a driving section of intermediate conveyance unit B.

Conveyance path switching member G1 that supports feed-in follower roller R10 and feed-out follower roller R11 is driven by solenoid SOL1 to swing. Feed-in drive roller R3 is driven by solenoid SOL2 to open and close sheet conveyance path r11. Longitudinal alignment plate 124 is driven by solenoid SOL3 to swing.

Motor M1 drives conveyance rollers R2 to rotate, and allows feed-in drive roller R3 to rotate through belt 120. Further, the motor M1 drives conveyance rollers R1 located at the upstream side of the conveyance rollers R2 to rotate. The conveyance rollers R1 and R2 are controlled to be at the same speed as a sheet ejection linear speed of the sheet on sheet ejection roller 5E of image forming apparatus body A.

The sheet ejection linear speed by sheet ejection roller 5E of image forming apparatus body A is controlled depending on basis weight of the sheet, and it is also controlled to be of a different value, depending on an occasion where the sheet is reversed upside down after fixing to be ejected, and an occasion where the sheet is not reversed upside down to be ejected straight. For example, when basis weight of the sheet is 50-91 g/m$^2$, the sheet ejection linear speed for ejecting the sheet straight without reversing upside down is 490 mm/s, while, the sheet ejection linear speed for ejecting the sheet after reversing upside down is 1000 mm/s.

Further, when basis weight of the sheet is 92-161 g/m$^2$, the sheet ejection linear speed for ejecting the sheet straight without reversing upside down is 425 mm/s, while, the sheet ejection linear speed for ejecting the sheet after reversing upside down is 825 mm/s. Furthermore, when basis weight of the sheet is 162-300 g/m$^2$, the sheet ejection linear speed for ejecting the sheet straight without reversing upside down is 290 mm/s, while, the sheet ejection linear speed for ejecting the sheet after reversing upside down is 520 mm/s.

Control section 9B in intermediate conveyance unit B receives information about the sheet ejection linear speed from a communication section of control section 9A of image forming apparatus body A, through communication line 9C (see FIG. 1). The control section 9B controls driving of motor M1 based on the received information concerning the sheet ejection linear speed, and switches the linear speeds of conveyance rollers R1 and R2 to be the same as sheet ejection linear speed of image forming apparatus body A. Owing to this, it is possible to prevent buckling, damage and jam of the sheet caused by a difference between the sheet ejection linear speed of image forming apparatus body A and the linear speed in feed-in of intermediate conveyance unit B.

Motor M2 drives feed-out drive roller R4, intermediate conveyance rollers R5 and sheet ejection rollers R6 to rotate. Post-processing apparatus FS to be coupled at the downstream side of intermediate conveyance unit B is controlled so that it may receive the sheet from the intermediate conveyance unit B at the same linear speed (for example, 1000 mm/s), independently of its type, and the linear speed is changed to the speed matching each post-processing function after receiving the sheet. Therefore, the motor M2 is controlled in terms of driving by the control section 9B to be constant, independently of the type of the post-processing apparatus coupled at the downstream side, thus, the feed-out drive roller R4, intermediate conveyance rollers R5 and sheet ejection rollers R6 are driven to rotate at the same linear speed.

Stop member 123 is fixed on belt 125 that is rotated by motor M3, and is guided by guide bar 126 to go up and down.

Figure 4:
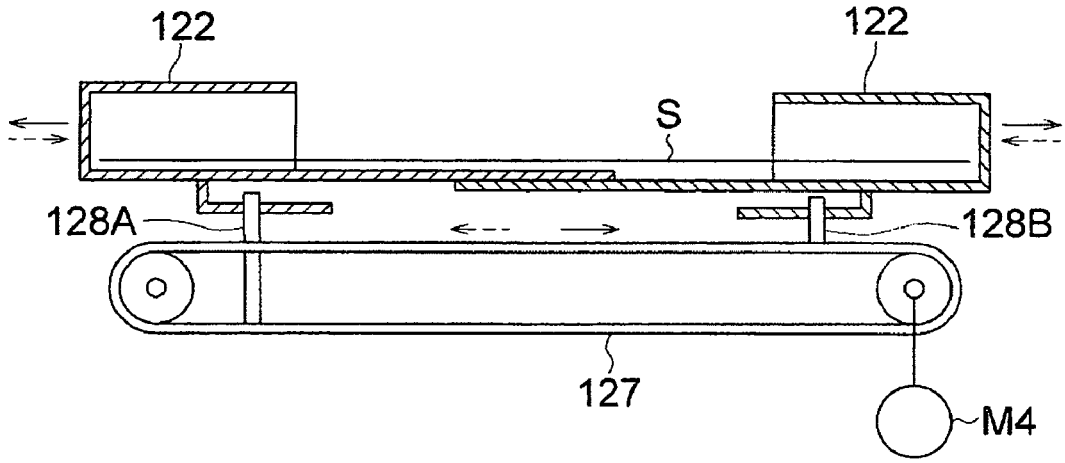
FIG. 4 is a sectional view showing a drive section for a lateral alignment plate.

FIG. 4 is a sectional view showing a drive section for lateral alignment plate 122.

Paired lateral alignment plates 122 on the right and left are engaged with pins 128A and 128B both fixed on belt 127 that is rotated by motor M4 to move in the lateral direction of the sheet for width alignment.

Each of FIGS. 5-8 is a sectional view showing how a sheet is conveyed in intermediate conveyance unit B. How a sheet is conveyed in intermediate conveyance unit B will be explained as follows.

Figure 5:
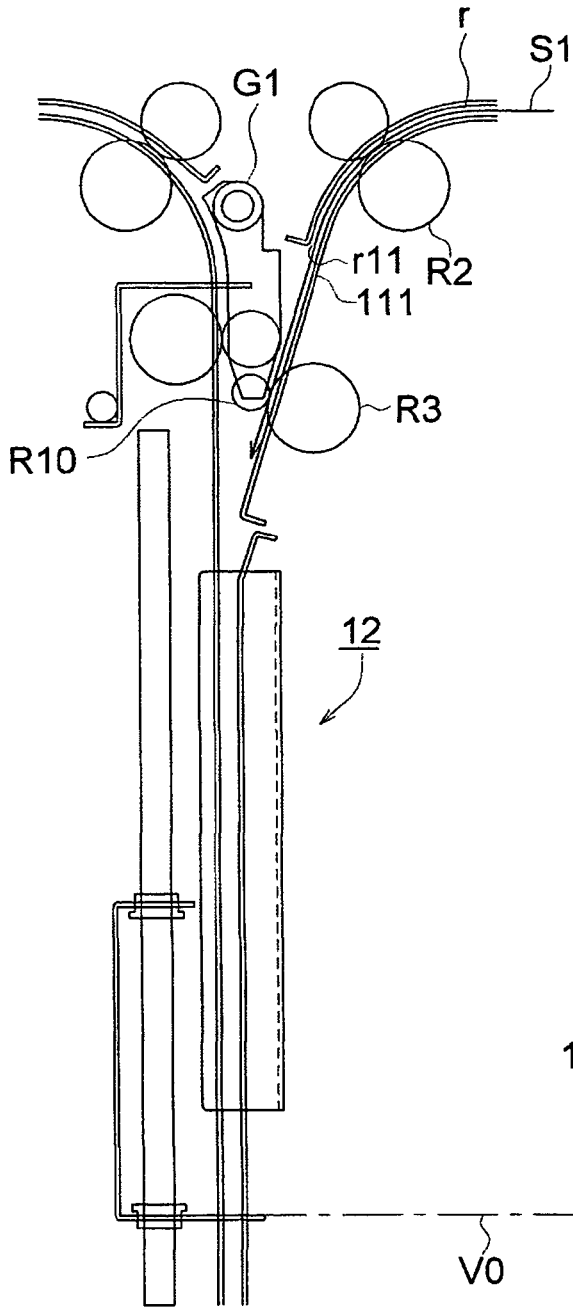
FIGS. 5(*a*) and 5(*b*) are sectional views showing how a sheet is conveyed in an intermediate conveyance unit.
Figure 5:
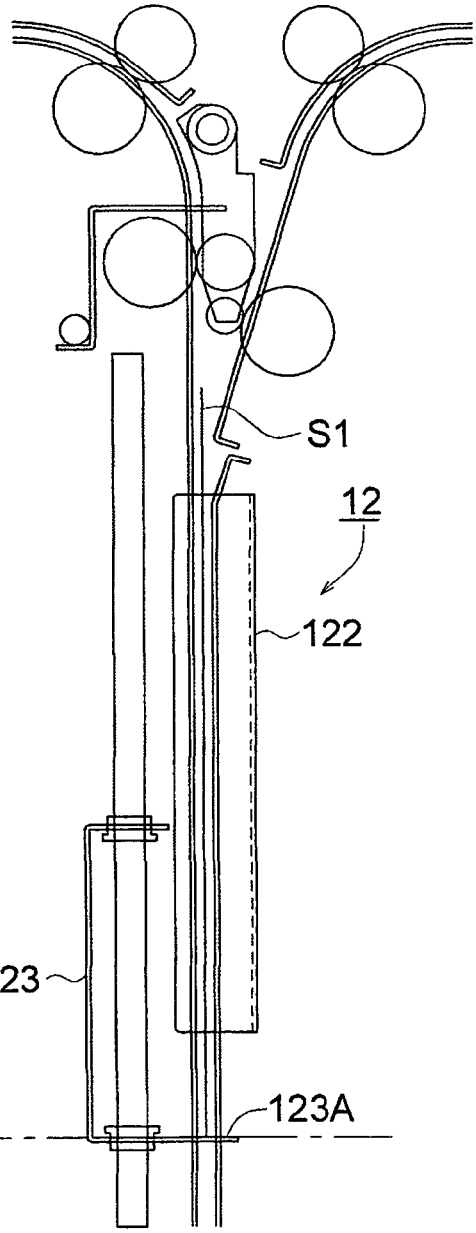

(1). In FIG. 5 (*a*), feed-in follower roller R10 that is supported rotatably at an end portion of conveyance path switching member G1 comes in pressure contact with rotating feed-in drive roller R3 to be driven to rotate. The first sheet S1 nipped between conveyance rollers R2 rotating at linear speed identical to that of sheet ejection roller 5E of image forming apparatus body A to be conveyed is moved along guide plate 111 of sheet conveyance path r11, then, is conveyed while being nipped by feed-in drive roller R3, and advances toward sheet storing section 12.

(2) In FIG. 5 (*b*), a leading edge of the first sheet S1 conveyed to the sheet storing section 12 hits stopper surface 123A of stop member 123 and stops.

Figure 6:
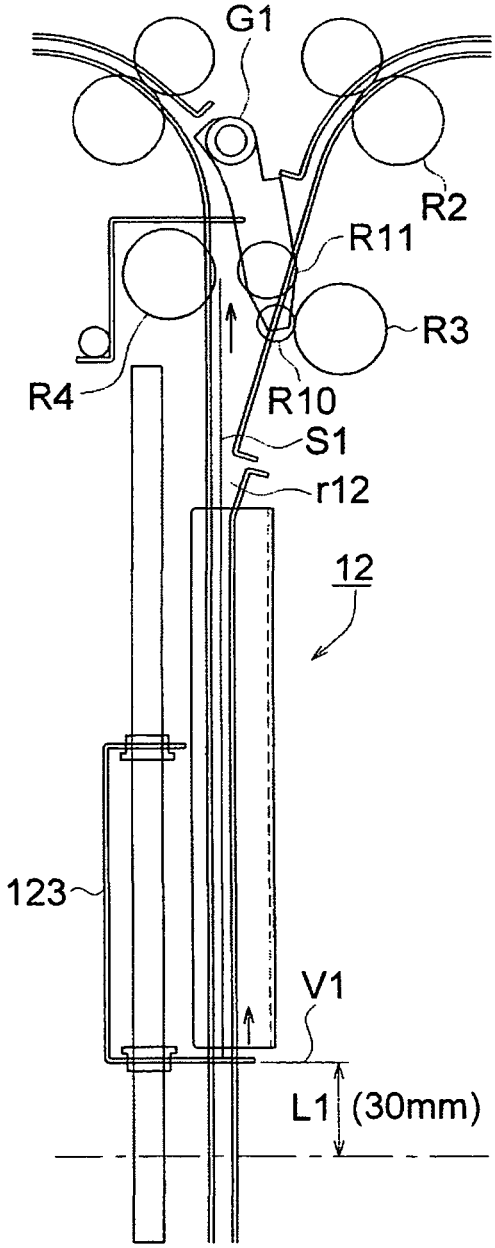
FIGS. 6(*a*) and 6(*b*) are sectional views showing how a sheet is conveyed in an intermediate conveyance unit.
Figure 6:
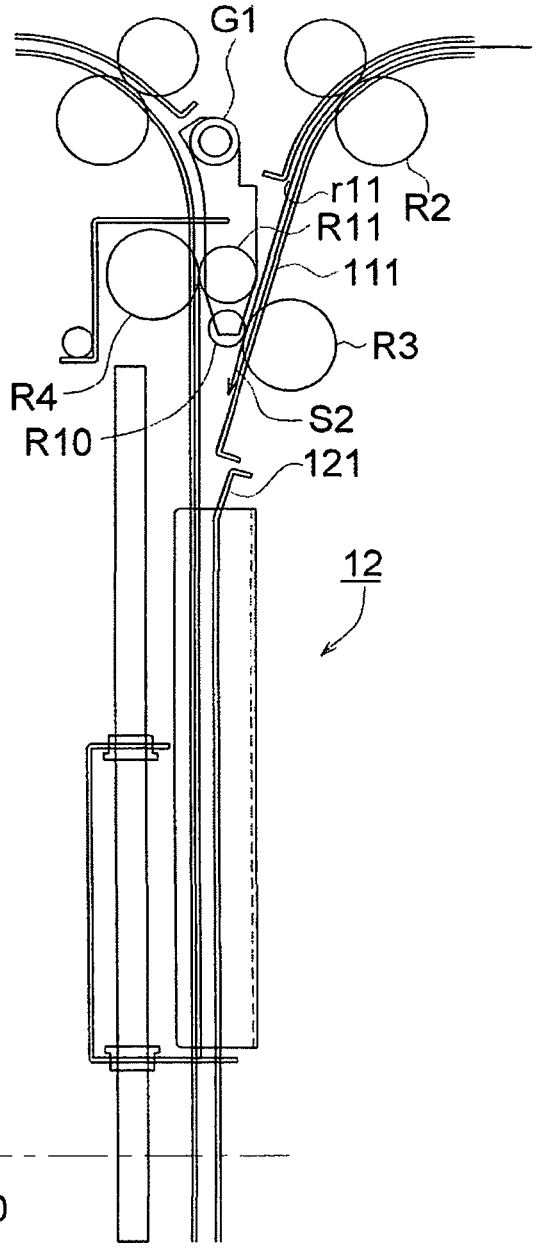

(3) In FIG. 6 (*a*), conveyance path switching member G1 is operated, and feed-out follower roller R11 supported rotatably at an intermediate portion of the conveyance path switching member G1 is separated from feed-out drive roller R4. In this case, feed-in drive roller R3 is pressed by feed-out follower roller R10 to be swung around conveyance roller R2 to retreat. After that, the stop member 123 is moved by motor M3 (see FIG. 3) to the first position V1 that is higher than initial position V0 by prescribed distance L1 (for example, 30 mm), and is stopped when a leading edge of sheet S arrives at the vicinity of the feed-out drive roller R4. This prevents that a leading edge of sheet S2 hits a trailing edge of foregoing sheet S1 when the second sheet S2 is conveyed into the sheet storing section 12, and occurrence of jam, buckling of the sheet and disturbed page order can be prevented.

(4) In FIG. 6 (*b*), conveyance path switching member G1 returns to its original position. Owing to this, feed-in drive roller R3 and feed-in follower roller R10 also return to their original positions while keeping the state of pressure contact. Simultaneously with the foregoing motion, feed-out drive roller R4 and feed-out follower roller R11 come into pressure contact with each other. The second sheet S2 interposed by conveyance rollers R2 to be conveyed is moved along guide plate 111 of sheet conveyance path r11, then, is conveyed while being nipped between feed-in drive roller R3 and feed-in follower roller R10, and advances toward sheet storing section 12.

Figure 7:
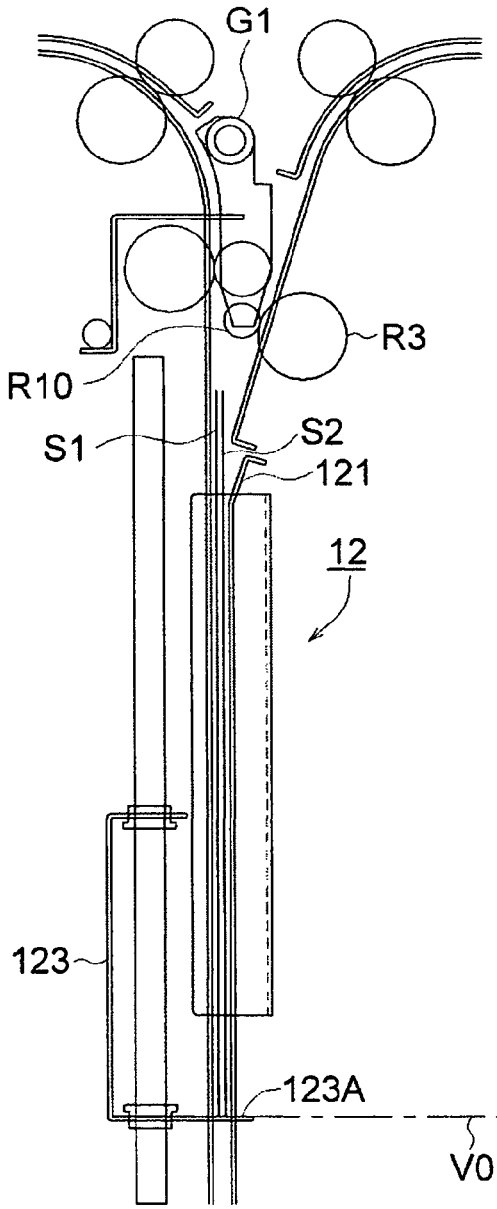
FIGS. 7(*a*) and 7(*b*) are sectional views showing how a sheet is conveyed in an intermediate conveyance unit.
Figure 7:
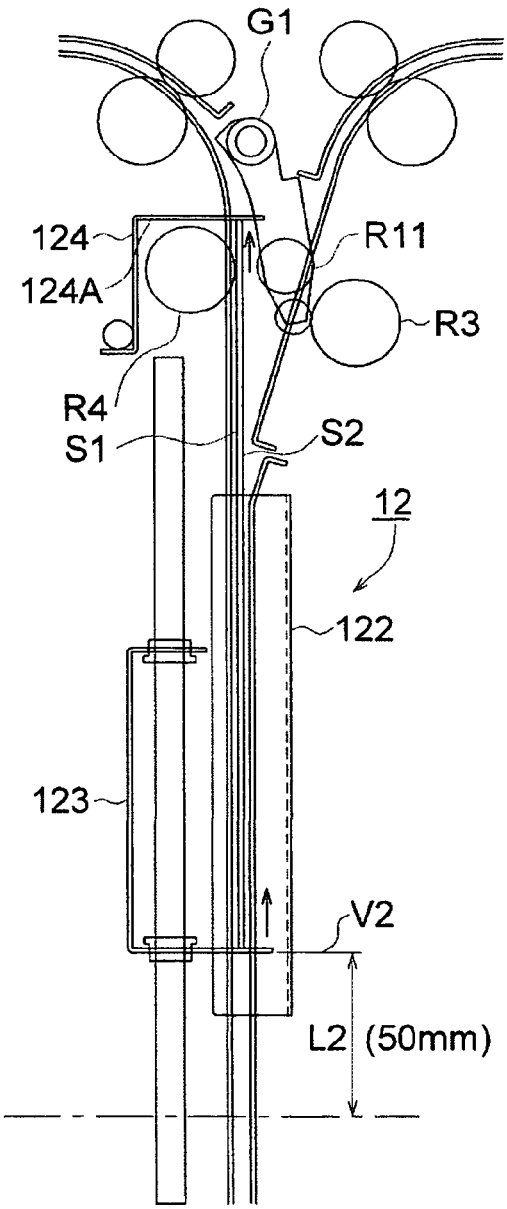

(5) In FIG. 7 (*a*), the second sheet S2 is moved along guide plate 121 of sheet conveyance path r12 of sheet storing section 12, and a leading edge of the second sheet S2 hits stopper surface 123A of stop member 123, and stops. In this case, the stop member 123 is in the initial position V0 that is lower than the first position V1. In this stop position, the second sheet S2 enters the situation where it is superposed on the first sheet S1.

(6) In FIG. 7 (*b*), conveyance path switching member G1 is operated in the same way as in FIG. 6 (*a*), and feed-out follower roller R11 is separated from feed-out drive roller R4. After that, stop member 123 is moved by motor M3 (see FIG. 3) to the second position V2 that is upper than the first position V1 and is higher than initial position V0 by prescribed distance L2 (for example, 50 mm), and upper end portions of two superposed sheets S1 and S2 hit stopper surface 124A of longitudinal alignment plate 124 to stop, and longitudinal alignment is carried out. The stop position for the upper end portions of the two longitudinally aligned sheets S1 and S2 is on the downstream side of a nip position of feed-out drive roller R4 in the conveyance direction. Simultaneously with or after completion of longitudinal alignment, lateral alignment mechanism 122 is driven by motor M4 (see FIG. 4), to press side edges of the sheets S1 and S2 in the width direction, thus, lateral alignment is carried out.

Figure 8:
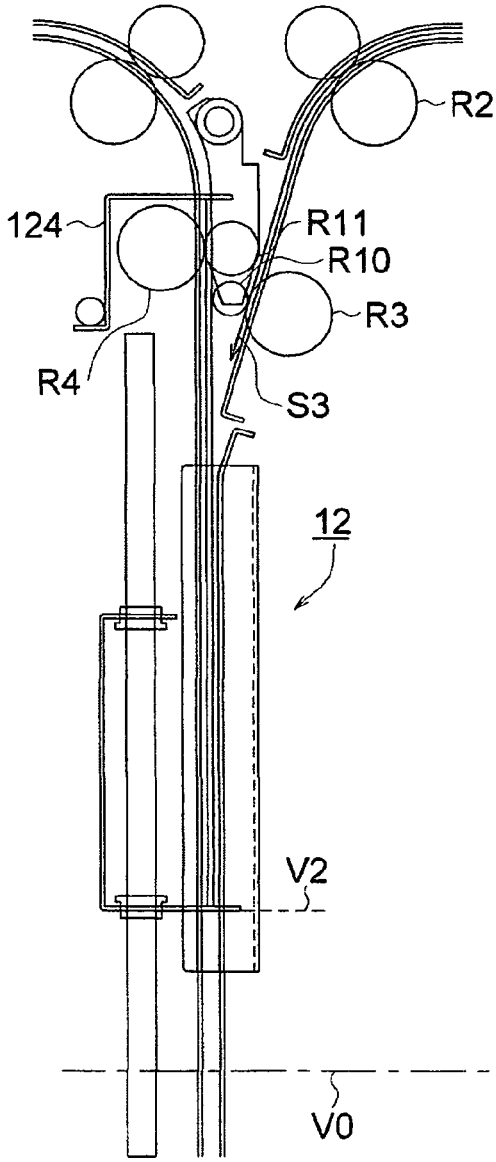
FIGS. 8(*a*) and 8(*b*) are sectional views showing how a sheet is conveyed in an intermediate conveyance unit.
Figure 8:
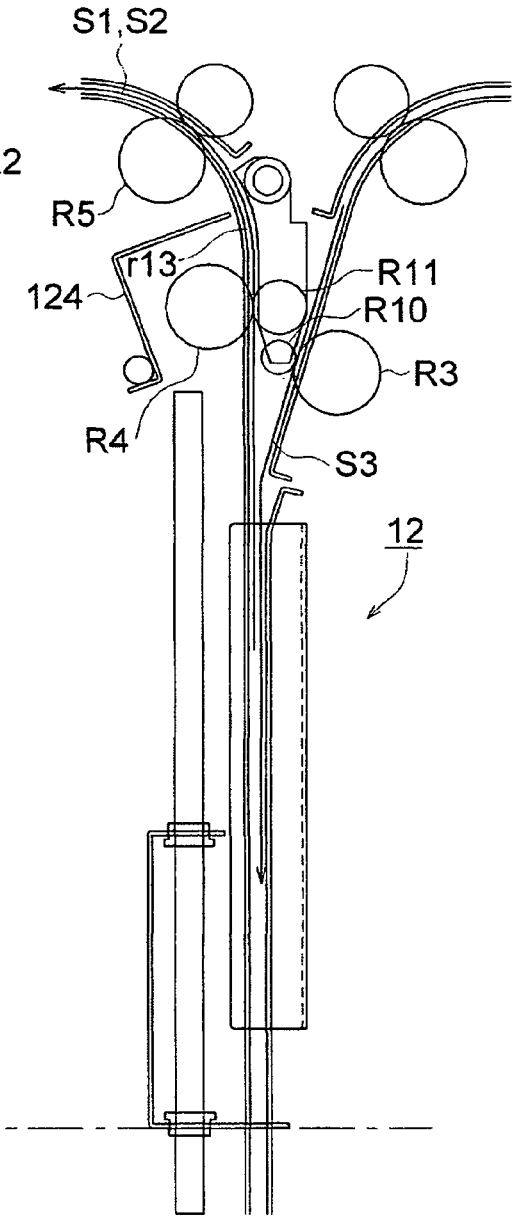

(7) In FIG. 8 (*a*), conveyance path switching member G1 returns to its original position, in the same way as in FIG. 6 (*b*). Owing to this, feed-in drive roller R3 and feed-in follower roller R10 also return to their original positions while keeping the state of pressure contact, to make conveyance of the third sheet S3 possible. Simultaneously with the foregoing motion, feed-out drive roller R4 and feed-out follower roller R11 come into pressure contact with each other to nip upper end portions of two superposed sheets S1 and S2.

(8) In FIG. 8 (*b*), longitudinal alignment plate 124 is driven by solenoid SOL3 (see FIG. 3) to retreat from sheet conveyance path r13. Two sheets S1 and S2 nipped by feed-out drive roller R4 and feed-out follower roller R11 are conveyed by driven rotation of the feed-out drive roller R4, and are further nipped by intermediate conveyance rollers R5 to be ejected. In this case, the sheets are ejected at the same speed as the receiving linear speed of post-processing apparatus FS coupled at the downstream side. Virtually simultaneously, the third sheet S3 nipped and conveyed by feed-in drive roller R3 and feed-in follower roller R10 advances toward sheet storing section 12.

By superposing plural sheets in an intermediate conveyance unit to convey them simultaneously to a post-processing apparatus, it is possible to conduct post-processing while conducting image forming by an image forming apparatus body at high speed without reducing the processing speed of the image forming apparatus body corresponding to the post-processing, and productivity of an image forming apparatus is improved.

Owing to intermediate conveyance unit B of the invention, plural sheets S stored in sheet storing section 12 are aligned laterally by lateral alignment mechanism 122 in the direction of sheet width, and sheets are superposed on each other.

Plural sheets S stored in sheet storing section 12 are aligned longitudinally in the direction of sheet conveyance, and they are superposed on each other.

Further, sheet S conveyed into sheet storing section 12 falls with its own weight, and a leading edge of the sheet S hits stop member 123 and the sheet stops, which prevents occurrence of sheet jam in a conveyance path in the sheet storing section 12.

Since there is provided a sheet reversing section that reverses upside down two or more sheets which are fed out of sheet storing section 12 and are superposed, it is not necessary to reverse sheets upside down in advance in image forming apparatus body A to eject.

In the case of a hole-punching and folding unit that is installed as a succeeding post-processing apparatus, when intermediate conveyance unit B superposes two or more sheets S and transports them to the succeeding hole-punching and folding unit, hole-punching processing and folding processing can be applied simultaneously for two or more sheets S.

In the case of a side stitching unit that is installed as a succeeding post-processing apparatus, when intermediate conveyance unit B superposes two or more sheets S and transports them to the succeeding-side stitching unit, to form a bundle of sheets, side stitching processing can be practiced rapidly.

In the case of a saddle stitching unit that is installed as a succeeding post-processing apparatus, when intermediate conveyance unit B superposes two or more sheets S and transports them to the succeeding saddle stitching unit, to form a bundle of sheets, saddle stitching processing and center folding processing can be practiced rapidly.

In the case of a pasting and bookbinding unit that is installed as a succeeding post-processing apparatus, when intermediate conveyance unit B superposes two or more sheets S and transports them to the succeeding bookbinding unit, to form a bundle of sheets, bookbinding processing can be conducted rapidly.

In the case of a large capacity stacking unit that is installed as a succeeding post-processing apparatus, when intermediate conveyance unit B superposes two or more sheets S and transports them to the succeeding large capacity stacking unit, a large number of sheets can be stacked rapidly without reduction of sheet conveyance speed of an image forming apparatus caused by standby time in the case of sheet conveyance processing of a large capacity stacking unit.

Intermediate conveyance unit B of the invention is equipped with feed-in drive roller R3 that is supported to be capable of swinging and feed-in follower roller R10 that is in pressure contact with the feed-in drive roller R3 to be driven to rotate, and switching between arrangement of a sheet conveyance path in the case of sheet feed-in and retreating from the path in the case of feed-out of superposed sheets can be carried out without fail.

Further, intermediate conveyance unit B of the invention is equipped with feed-out drive roller R4 and feed-out follower roller R11 that can touch and separate from the feed-out drive roller R4, and switching between longitudinal alignment of sheets S in the conveyance direction and sheet feed-out can be carried out without fail.

Since feed-in follower roller R10 making pressure contact with feed-in drive roller R3 and feed-out follower roller R11 making pressure contact with feed-out drive roller R4 are supported on conveyance path switching member G1 which can swing, sheet feed-in from sheet feed-in section 11 and sheet feed-out to sheet feed-out section 13 can be switched surely by a simple structure.

Further, with respect to a longitudinal alignment mechanism having longitudinal alignment member 124 which can swing and stop member 123 which can go up and down, a stop position of the stop member 123 is movable depending on a sheet size, whereby, sheets S in various sizes can be handled. In addition, since sheet conveyance directions of plural sheets S stored in sheet storing section 12 are aligned longitudinally and sheets are superposed, there is no decline of a conveyance speed caused by longitudinal alignment, which makes it possible to conduct longitudinal alignment processing while performing high speed conveyance.

Meanwhile, the number of sheets S stored in the sheet storing section 12 is not limited to two sheets, and the number of sheets is established by post-processing characteristics of the succeeding post-processing apparatus connected to intermediate conveyance unit B.

(Sheet Post-Processing Apparatus)

Various types of post-processing apparatuses will be explained as follows. They are hole-punching and folding unit FS1, side stitching unit FS2, saddle stitching unit FS3, large capacity sheet stacking unit (hereinafter referred to as large capacity stacker) FS4 and pasting and bookbinding unit FS5.

(Hole-Punching and Folding Unit)

Figure 9:
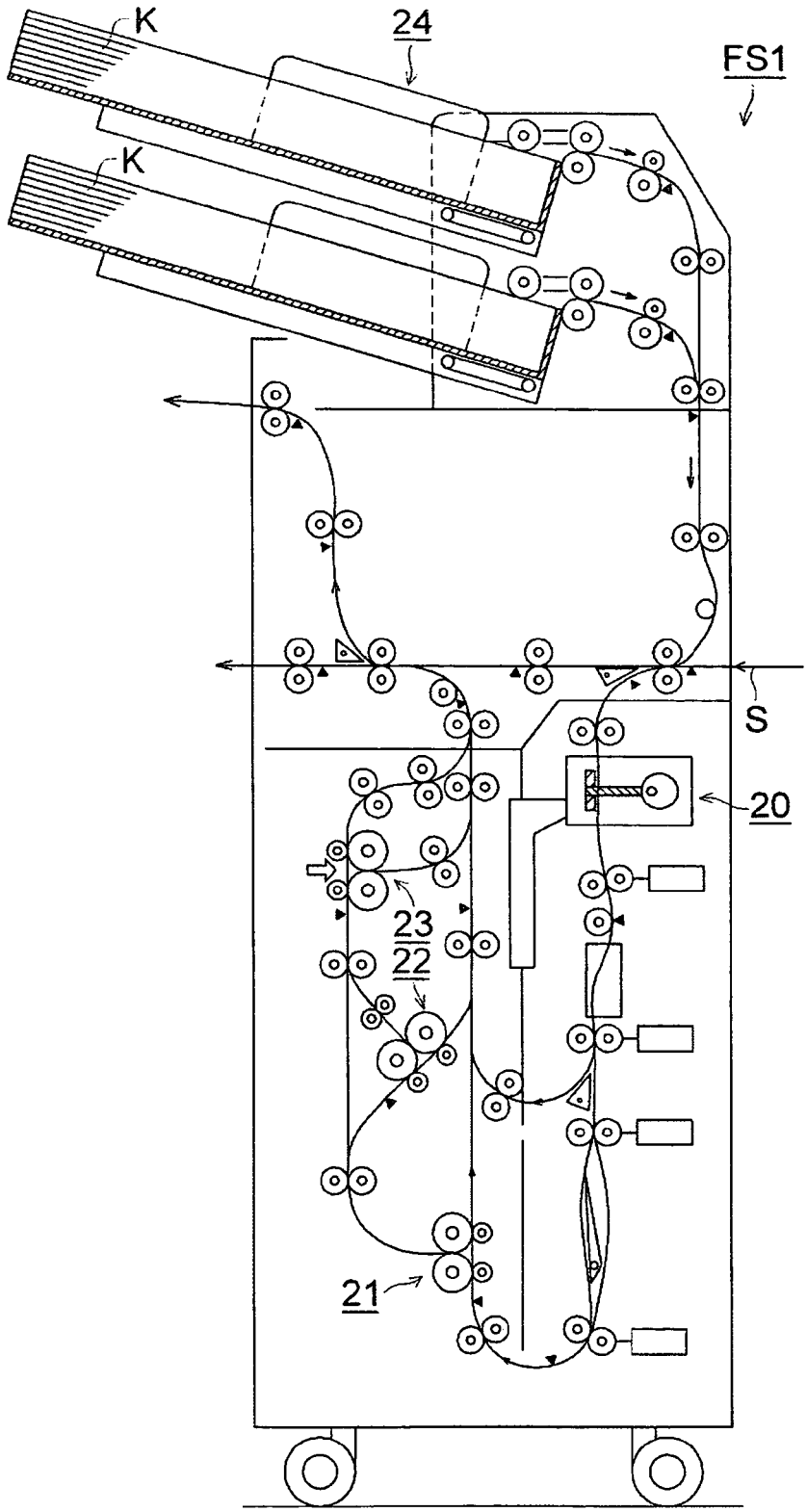
FIG. 9 shows a total structural diagram of a hole-punching and folding unit.

FIG. 9 shows a total structural diagram of hole-punching and folding unit (post-processing apparatus) FS1.

The hole-punching and folding unit FS1 is composed of hole-punching processing section 20, first folding section 21, second folding section 22, third folding section 23 and cover sheet supply section 24, and it conducts post-processing including hole-punching processing and various types of folding processing for sheets S on which images have been formed, or for cover sheet K.

Figure 10:
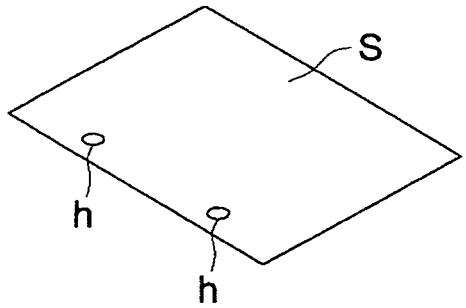
FIGS. 10(*a*)-10(*h*) are perspective views of a sheet after hole-punching processing and various folding processes.
Figure 10:
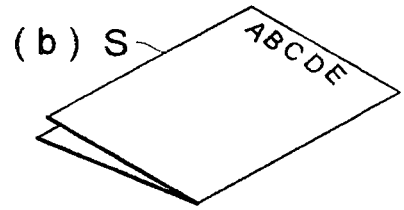
Figure 10:
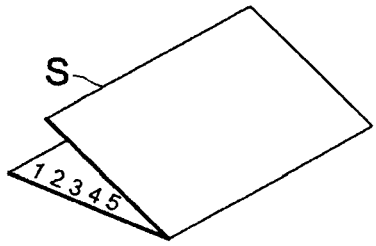
Figure 10:
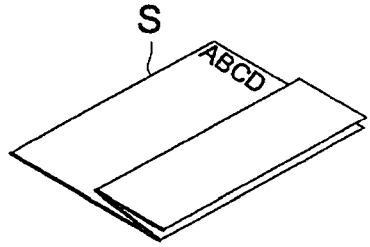
Figure 10:
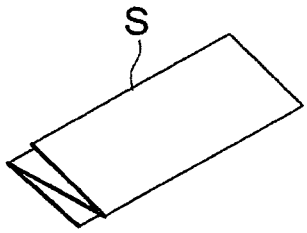
Figure 10:
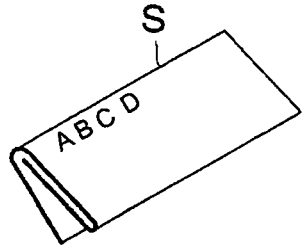
Figure 10:
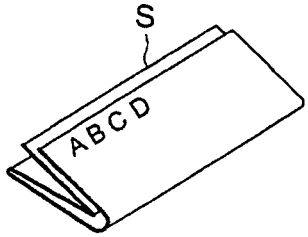
Figure 10:
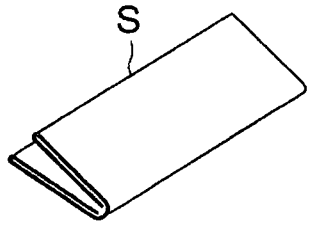

FIG. 10 is a perspective view of sheet S after hole-punching processing and various folding processes.

FIG. 10 (*a*) shows sheet S on which two holes were punched through hole-punching processing in the hole-punching processing section 20, FIG. 10 (*b*) shows sheet S which was center-folded with its image surface facing outward in the first folding section 21, FIG. 10 (*c*) shows sheet S which was center-folded with its image surface facing inward in the third folding section 23, FIG. 10 (*d*) shows sheet S which was Z-folded with its image surface facing inward in the first folding section 21 and the third folding section 23, FIG. 10 (*e*) shows sheet S which was folded into three outward in the first folding section 21 and the second folding section 22, FIG. 10 (*f*) shows sheet S which was folded into three inward in the first folding section 21 and the second folding section 22, FIG. 10 (*g*) shows sheet S which was subjected to double parallel folding in the first folding section 21 and the second folding section 22 and FIG. 10 (*h*) shows sheet S which was folded into four in the first folding section 21, the second folding section 22 and third folding section 23.

In the hole-punching and folding unit FS1, 500 cover sheets K are loaded in each of two steps of cover sheet supply section 24.

(Side Stitching Unit)

Figure 11:
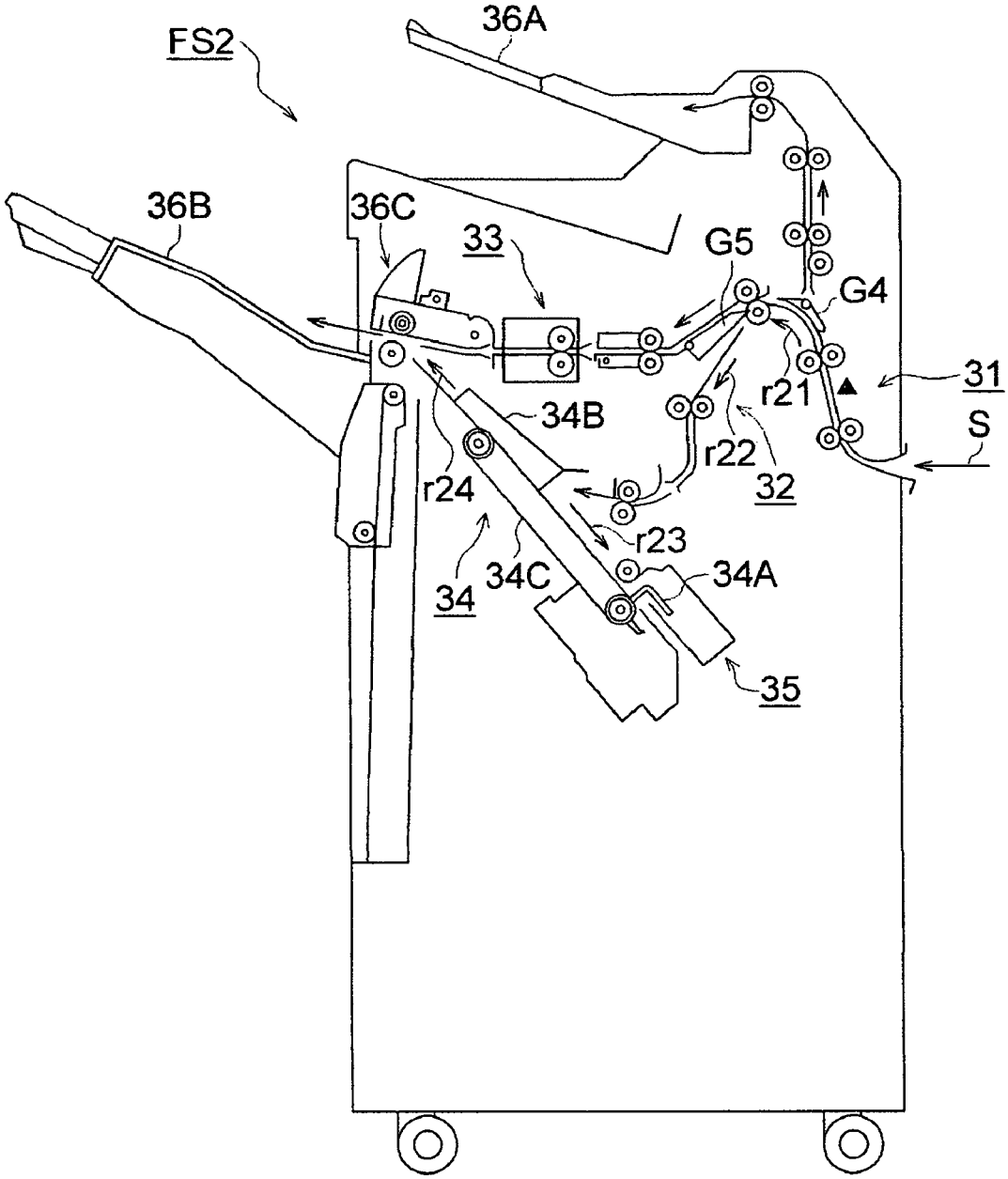
FIG. 11 shows a total structural diagram of a side stitching unit.

FIG. 11 shows a total structural diagram of side stitching unit (post-processing apparatus) FS2.

The side stitching unit FS2 is composed of entrance conveyance section 31, intermediate conveyance section 32, shift processing section 33, stacker unit 34, stapler unit 35 and a sheet ejection section. The sheet ejection section is composed of sub-tray 36A on the uppermost step, main tray 36B that can move up and down on the left side in the illustration and of a sheet ejection section.

Sheet S passing through the entrance conveyance section 31 is branched to advance to any one of simple sheet ejection where the sheet is ejected to sub-tray 36A, straight sheet ejection where the sheets are ejected to main tray 36B and side stitching sheet ejection where the sheets are subjected to side stitching and are ejected, depending on the selection of swing angles of conveyance path switching members G4 and G5.

Sheet S to be subjected to side stitching processing passes through sheet conveyance path r21 below conveyance path switching member. G4, then, passes through sheet conveyance path r22 below conveyance path switching member G5, and slides down on the inclined surface of stacker unit 34 (r23) and stops when a leading edge of sheet S in its traveling direction hits a sheet stopper surface of side stitching stopper 34A. Width alignment section 34B aligns the width of sheets S stacked on stacker unit 34.

At this stop position, when sheets S in prescribed number are stacked and aligned on stacker unit 34, side stitching processing is conducted by stapler unit 35 composed of a stapling mechanism and a staple accepting mechanism, and sheets S are stitched.

Ejection belt 34C of stacker unit 34 pushes stitched sheets S upward obliquely, then, holds them with sheet ejection unit 36C to convey them (sheet conveyance path r24), and ejects and stacks them on main tray 36B capable of going up and down.

Side stitching unit FS2 conducts side stitching processing on sheets S in quantity of maximum 100 sheets to make a booklet.

(Saddle Stitching Unit)

Figure 12:
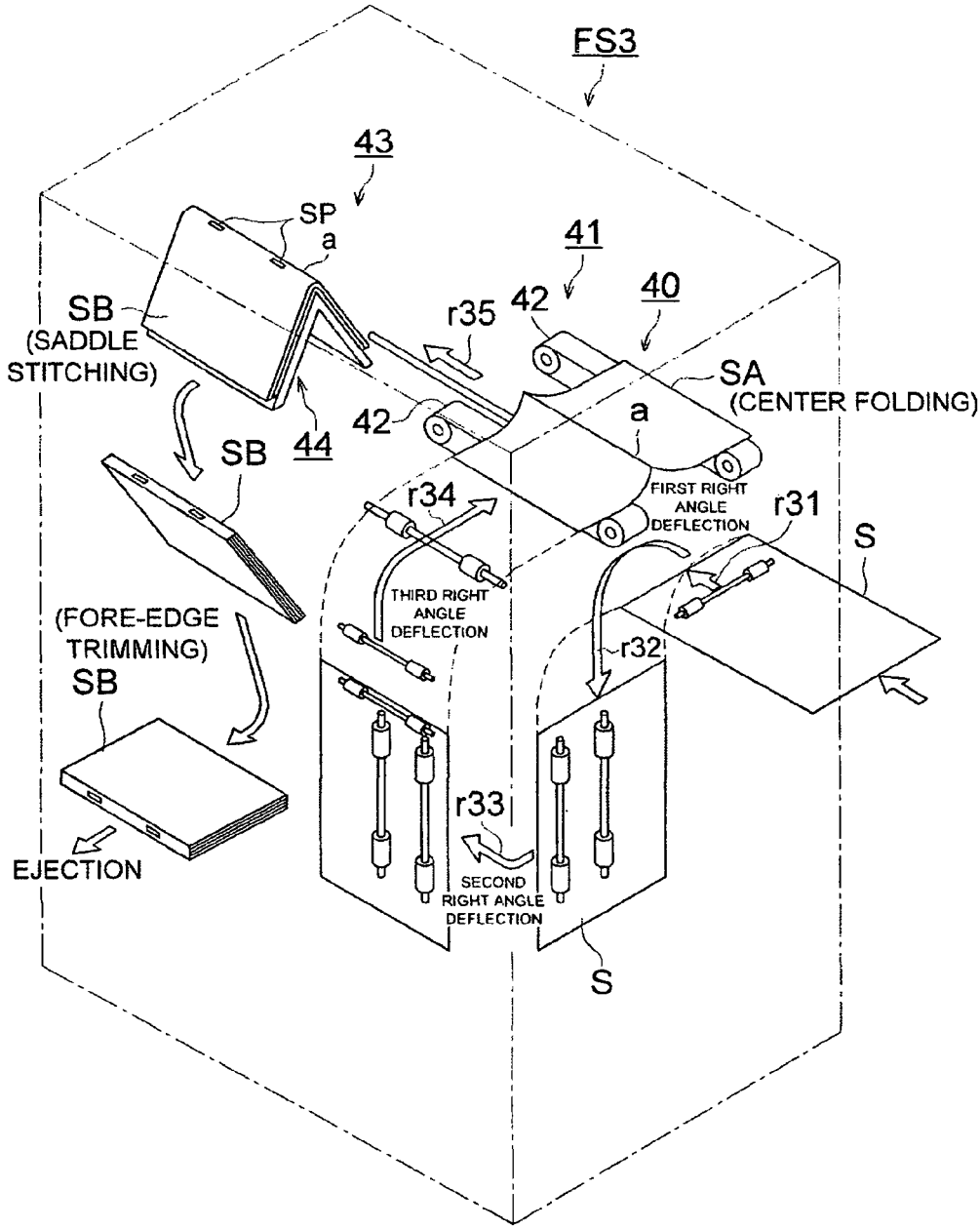
FIG. 12 is a pattern diagram showing sheet conveyance for center folding and saddle stitching processes by a saddle stitching unit.

FIG. 12 is a pattern diagram showing sheet conveyance for center folding and saddle stitching processes by a saddle stitching unit (post-processing apparatus) FS3.

Sheet S introduced into the saddle stitching unit FS3 is conveyed from sheet conveyance path r31 which is substantially horizontal to lower sheet conveyance path r32 which is substantially vertical and held there (first right angle deflection conveyance). The sheet S thus held is deflected and moved to pass through sheet conveyance path r33 with its sheet surface standing erect, and it stops momentarily at a prescribed position (second right angle deflection conveyance). Next, the sheet S is conveyed upward vertically by a pair of conveyance rollers, and then, is deflected to be horizontal to be moved, and is stopped at a prescribed position (third right angle deflection conveyance, sheet conveyance path r34). After positioning of sheet S is carried out in this stop position, center folding processing is conducted by folding section 40.

One or plural sheets S stopped at the folding section 40 is interposed between folding rollers each rotating in the opposite direction to each other and a folding plate traveling straight, to be subjected to center folding, whereby, fold line portion "a" is formed in the sheet width direction at the center in the sheet conveyance direction.

Folded sheet SA is conveyed by conveyance belt 42 of conveyance section 41 to sheet conveyance path r35 in the direction of an extension line of the fold line portion "a", and is fed into the saddle stitching section 43.

As stated above, the folding section 40 conducts center folding on one or a small number of sheets S to make a fold line thereon securely, and feed them into the saddle stitching section 43 in sequence. Thereby, booklet (bound object) SB of high grade having less swelling on the fold line portion "a" can be prepared.

In the folding section 40, the center-folded sheet SA advances through sheet conveyance path r35, and is placed on saddled stacking section (stacker) 44 of the saddle stitching section 43. Succeeding center-folded sheet SA also passes through the sheet conveyance path r35, and is stacked on the saddled stacking section 44.

Plural folded sheets SA placed on the saddled stacking section 44 are aligned in terms of position by a width alignment section.

With respect to two-split structured stitching section composed of a stapling mechanism arranged above the saddled stacking section 44 and a staple accepting mechanism arranged inside the saddled stacking section 44, two sets thereof are arranged in the direction of a fold line portion. In the operation section, when saddle stitching processing is set, a staple accepting mechanism goes up and conducts saddle stitching processing. Namely, two sets of stitching sections drive stitching staples SP in at two locations on both sides of the center, along fold line portion "a" of folded sheet SA on the saddled stacking section 44.

The booklet SB which has been subjected to saddle stitching in the saddle stitching section 43 is taken out from the saddled stacking section 44 by a booklet take-out section and is cut by a fore-edge trimming unit so that booklet fore-edge is aligned. The booklet SB thus subjected to trimming processing and prepared is ejected to a sheet ejection tray.

Saddle stitching unit FS3 conducts center folding processing for sheets S in quantity of maximum 30 sheets, and prepares booklet SB of 120 pages on a two-sided pagination basis.

(Large Capacity Stacker)

Figure 13:
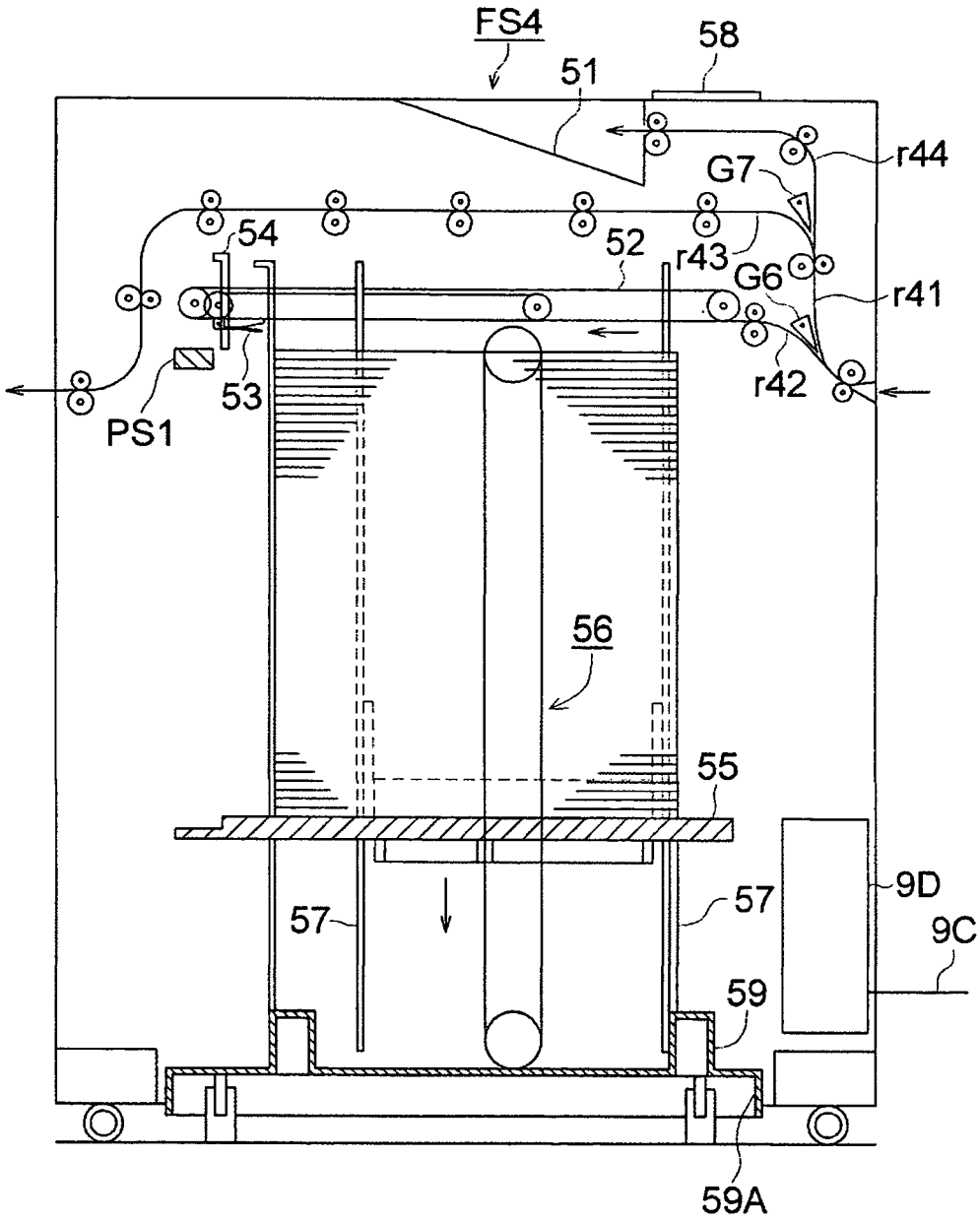
FIG. 13 is a front sectional view of a large capacity stacker.

FIG. 13 is a front sectional view of large capacity stacker FS4.

Sheet S that is ejected from image forming apparatus body A or from a post-processing apparatus and is introduced to an entrance portion of the large capacity stacker FS4 is conveyed to either one of sheet conveyance path r41 above conveyance path switching member G6 and sheet conveyance path r42 below conveyance path switching member G6. Sheet S branched to sheet conveyance path r41 is conveyed to either one of sheet conveyance path r44 above conveyance path switching member G7 and sheet conveyance path r43 below conveyance path switching member G7.

Sheet S advanced to the sheet conveyance path r44 is stacked on sub-sheet ejection tray 51 formed on the upper part of large capacity stacker FS4. Sheet S advanced to the sheet conveyance path r43 is ejected to the outside of the apparatus or it is fed into another large capacity stacker.

A leading edge of sheet S having entered the sheet conveyance path r42 is gripped by gripper 53 fixed on rotating belt 52, and the sheet S travels toward the left side in the illustration.

In the vicinity of the left end of the belt 52, sheet leading edge regulating member 54 is on standby. The sheet leading edge regulating member 54 moves to a prescribed position corresponding to a size of introduced sheet S to stop there, and conducts alignment of leading edges of sheets S.

When a leading edge of sheet S hits the sheet leading edge regulating member 54, gripping by the gripper 53 is released, and sheet S falls to be placed on sheet stacking table 55.

The sheet stacking table 55 is driven by rising and lowering drive section 56 composed of a motor and a rising and lowering member such as a belt or a wire, to move up and down along guide member 57.

When taking out sheet S loaded in large capacity stacker FS4, a release of the large capacity stacker FS4 is designated on operation display section 8 of image forming apparatus body A or on operation display section 58 of large capacity stacker FS4. Following this designation, rising and lowering drive section 56 lowers the sheet stacking table 55.

On the lower part of the large capacity stacker FS4, there is arranged sheet conveyance carriage 59 having wheels 59A to be movable. The sheet stacking table 55 is installed to come in contact with the upper surface of the sheet conveyance carriage 59, a wire of the rising and lowering drive section 56 further continues its rotation, and stops after releasing holding of the sheet stacking table 55.

When an operator opens a front door of the large capacity stacker FS4, and draws out the sheet conveyance carriage 59 toward the operator manually or electrically, the sheet S stacked on the sheet stacking table 55 installed on the sheet conveyance carriage 59 can be taken out easily.

Sheets S in quantity of the maximum about 5,000 sheets can be stacked on the sheet stacking table 55 in the large capacity stacker FS4. If two large capacity stackers FS4 are coupled, sheets S in quantity of maximum 10,000 sheets can be stacked.

A communication section of control section 9A arranged in image forming apparatus body A and a communication section of control section 9D arranged in large capacity stackers FS4 are connected by communication line 9C, and conduct giving and receiving of input signals and control signals.

When the sheet stacking table 55 is filled with sheets S which were introduced in large capacity stackers FS4 and stacked on the sheet stacking table 55 (for example, 5,000 sheets), and when sensor PS1 detects that a position of sheet stacking limit is exceeded, control section 9D switches the paths to feed sheets S ejected from image forming apparatus body A to sheet conveyance paths r41 and r43 from sheet conveyance path r42, to convey them to introduce to the large capacity stacker connected to the subsequent stage, thus, sheets S are stacked to be housed.

Sheets S ejected from image forming apparatus body A can be also housed in large capacity stacker FS4 while classifying and separating them for each of a sheet size, a basis weight and contents of recording for sheet S.

(Pasting and Bookbinding Unit)

Figure 14:
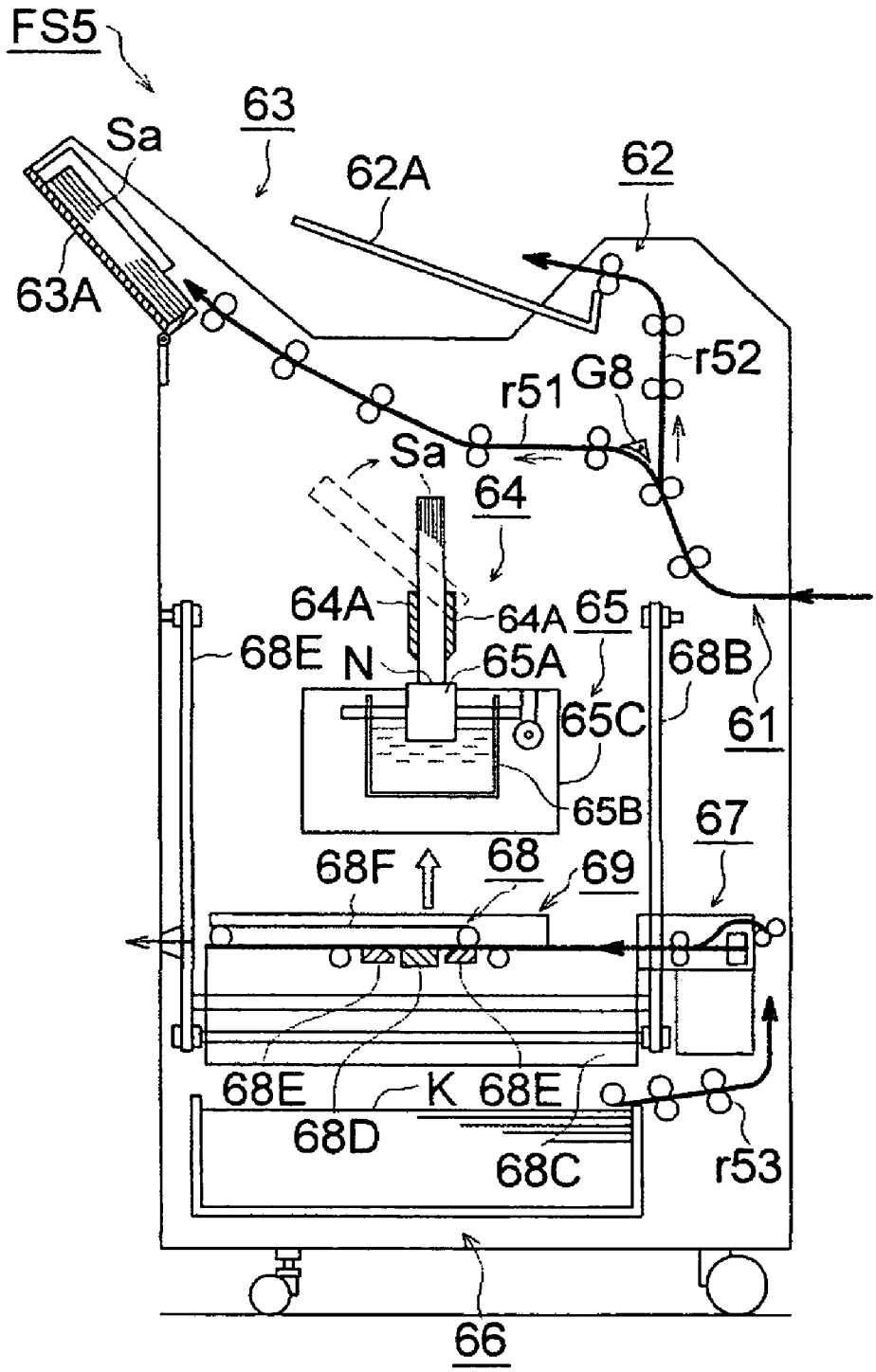
FIG. 14 is a front sectional view of a pasting and bookbinding unit.

FIG. 14 is a front sectional view of pasting and bookbinding unit (post-processing apparatus) FS5.

Pasting and bookbinding unit FS5 is equipped with sheet introduction section 61, sheet ejection section 62, sheet bundle housing section 63, sheet bundle conveyance section 64, paste coating section 65, cover sheet supply section 66, cover sheet cutting section 67, cover sheet outfitting section (wrapping-bookbinding section) 68 and alignment section 69. These respective sections are arranged on a tandem placement basis in the vertical direction substantially inside the pasting and bookbinding unit.

Sheet S introduced in sheet introduction section 61 is branched to either one of sheet ejection section 62 and sheet bundle housing section 63, by conveyance path switching member G8.

When sheet conveyance to sheet ejection section 62 is set, conveyance path switching member G8 intercepts sheet conveyance path r51 leading to sheet bundle conveyance section 64, and leaves sheet conveyance path r52 leading to sheet ejection section 62 open. Sheet S passing through sheet conveyance path r52 of sheet ejection section 62 is conveyed upward to be collected on sheet ejection table 62A fixed on the uppermost part of the apparatus. On the fixed sheet ejection table 62A, sheets S in quantity of maximum about 200 sheets can be stacked.

Sheets S branched by conveyance path switching member G8 to the left side in the illustration that is on the downstream side in the sheet conveyance direction, are held at a prescribed position of sheet bundle housing section 63 to be stacked in sequence, and are subjected to width alignment and longitudinal alignment, thus, sheet bundle Sa composed of prescribed number of sheets S is formed.

Sheet bundle Sa stacked on sheet stacking table 63A of sheet bundle housing section 63 is conveyed downward obliquely, and then, is held by holding section 64A of sheet bundle conveyance section 64, and is swiveled while the sheet bundle Sa is held, so that a surface (spine portion) of sheet bundle Sa to be coated with paste may face downward, thus, the sheet bundle Sa is retained at a prescribed position.

Paste coating section 65 is equipped with paste coating roller 65A, paste container 65B and moving body 65C that can move, while supporting the paste container 65B, from an initial position on the rear side of pasting and bookbinding unit FS5 to the paste coating position on the front side.

Cover sheet K loaded in cover sheet supply section 66 passes through sheet conveyance path r53 which further extends through cover sheet cutting section 67, and is conveyed to cover sheet outfitting section 68 where a trailing edge of the cover sheet K is cut to the prescribed length by the cover sheet cutting section 67. The length of the cover sheet K after being cut is equal to the length in which a thickness of the spine portion of the sheet bundle Sa is added to a length equivalent to two sheets S in their traveling direction.

The cover sheet outfitting section 68 receives cover sheet K fed from the cover sheet supply section 66 to convey it, and after being stopped at a prescribed position, the cover sheet K is subjected to positioning in its width direction by the alignment section 69. Then, the cover sheet outfitting section 68 causes rising and lowering section 68B to move movable casing 68C upward, and at the elevated position, a center section of cover sheet K placed on pressure member 68D comes in pressure contact with paste-coated surface N of sheet bundle Sa to be glued thereon.

Owing to a descent of the pressure member 68D facing the spine portion of the sheet bundle Sa and a movement of a pair of folding members 68E which are arranged on the upper part of the cover sheet outfitting section 68 to be symmetrical bilaterally, the cover sheet K is folded along side edges of the paste-coated surface N of the sheet bundle Sa, and thereby, the cover sheet K is superposed on both front and back surfaces of the sheet bundle Sa.

Figure 15:
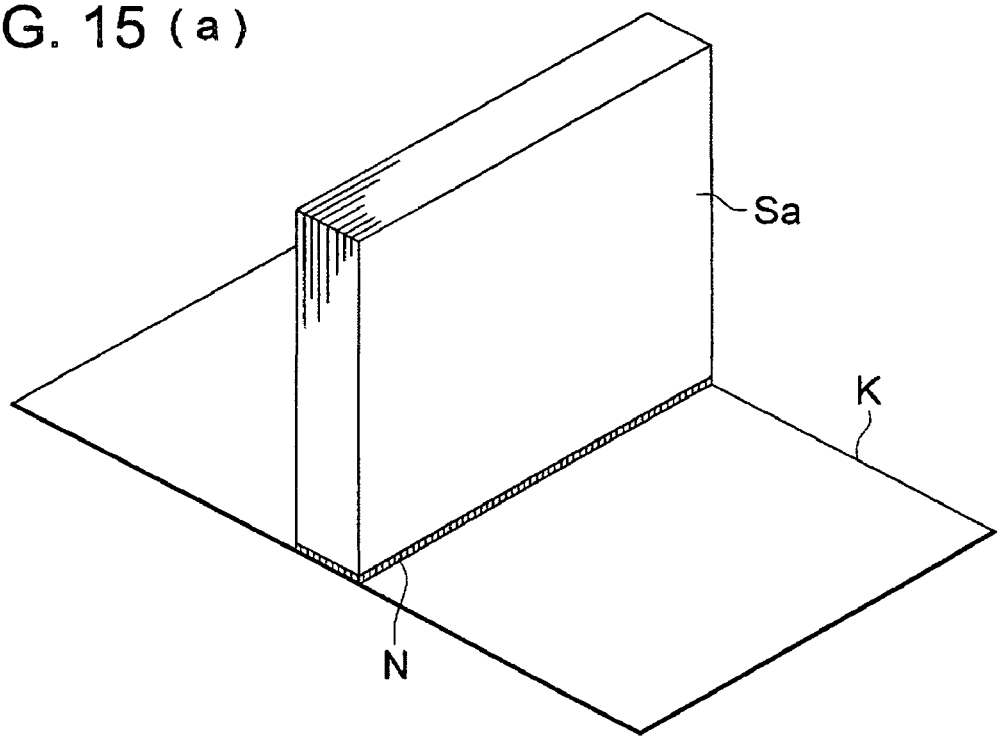
FIG. 15(*a*) shows a perspective view of a bundle of sheets on which a cover sheet is pasted and FIG. 15(*b*) shows a perspective view of a booklet that is bound by wrapping the bundle of sheets with the cover sheet.
Figure 15:
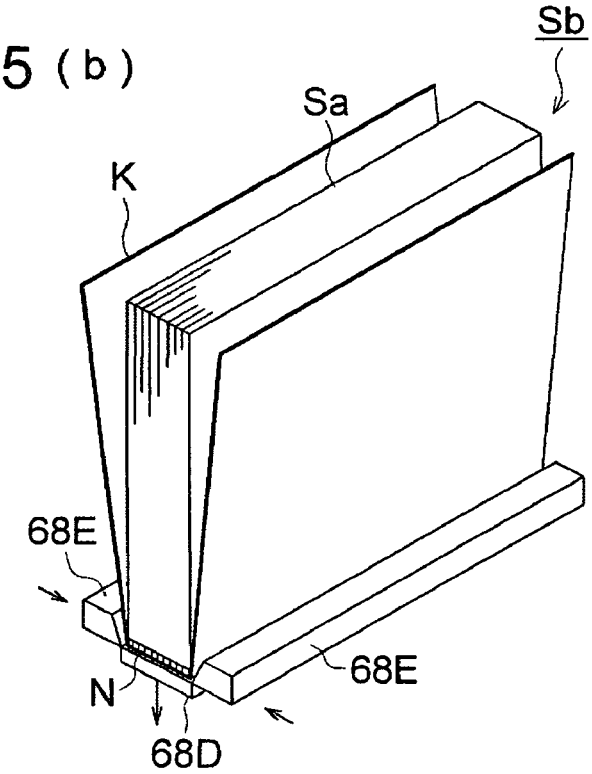

FIG. 15 (*a*) shows a perspective view of bundle of sheets Sa on which cover sheet K is pasted, and FIG. 15 (*b*) is a perspective view of booklet (bound object) Sb that is bound by wrapping the bundle of sheets Sa with the cover sheet K.

In FIG. 14, after completion of folding processing for cover sheet K, descent of the rising and lowering section 68B drives the cover sheet outfitting section 68 to lower to retreat, and after that, ejection belt 68F which has retreated to the outside of cover sheet K in the width direction together with retreat of alignment section 69 moves to the inside of booklet Sb in the width direction below the booklet Sb, and stops. After that, when holding by holding section 64A is released, the booklet Sb lowers and stops at the position where the lower spine portion of the booklet Sb comes in contact with the top surface of ejection belt 68F. The rotating ejection belt 68F ejects booklet Sb bound by wrapping the bundle of sheets Sa with cover sheet K to the outside of the apparatus.

Pasting and bookbinding unit FS5 can make booklet Sb by conducting pasting processing for sheets S in quantity of maximum 100 sheets.

(Image Forming Apparatus)

Figure 16:
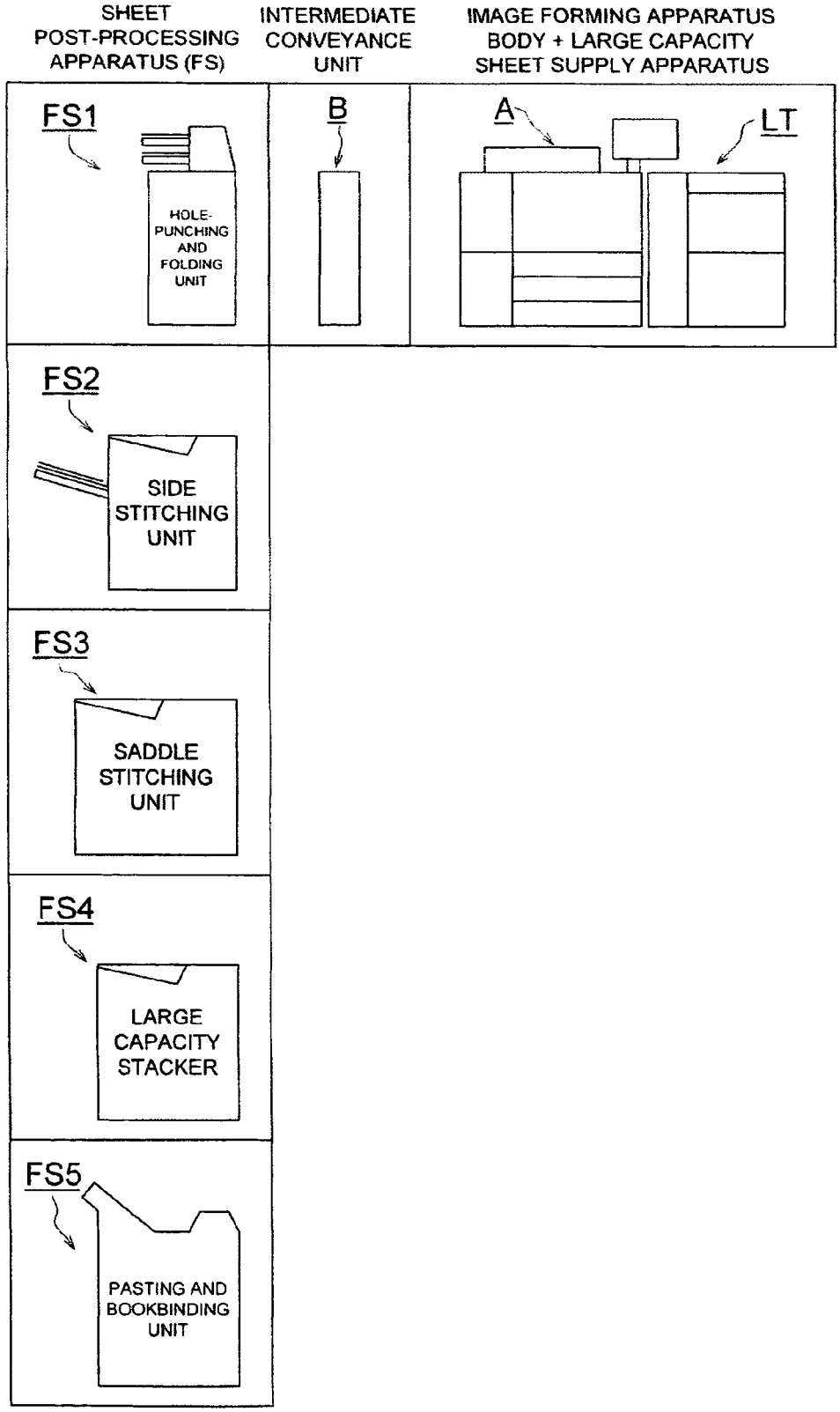
FIG. 16 is a pattern diagram showing the construction of an image forming apparatus body to which a large capacity sheet supply apparatus is connected, an intermediate conveyance unit and various kinds of individual post-processing apparatuses.

FIG. 16 is a pattern diagram showing the construction of image forming apparatus body A to which large capacity sheet supply apparatus LT is connected, intermediate conveyance unit B and of various individual post-processing apparatuses.

The image forming apparatus of the invention makes it possible to process through selection corresponding to all purposes of hole-punching, various types of folding processing, side stitching, saddle stitching and pasting and bookbinding, by selecting optionally hole-punching and folding unit FS1, side stitching unit FS2, saddle stitching unit FS3, large capacity stacker FS4 and pasting and bookbinding unit FS5 and by connecting these to image forming apparatus body A.

In various scales of offices, quick printing industry and data centers, there is achieved publishing-on-demand of an advanced type that outputs a large amount of multi-purpose post-processing at high speed.

Figure 17:
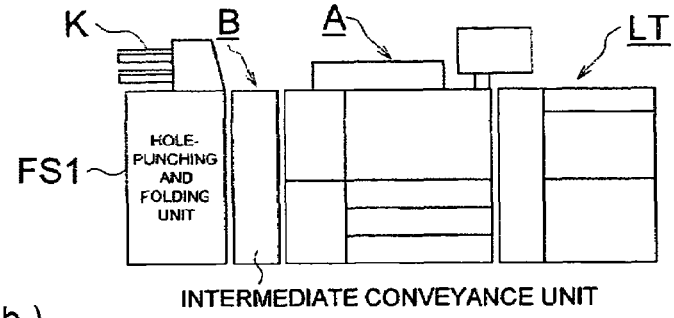
FIGS. 17(*a*)-17(*e*) are pattern diagrams of image forming apparatuses each being composed of an image forming apparatus body to which a large capacity sheet supply apparatus is connected, an intermediate conveyance unit and one of various kinds of individual post-processing apparatuses.
Figure 17:
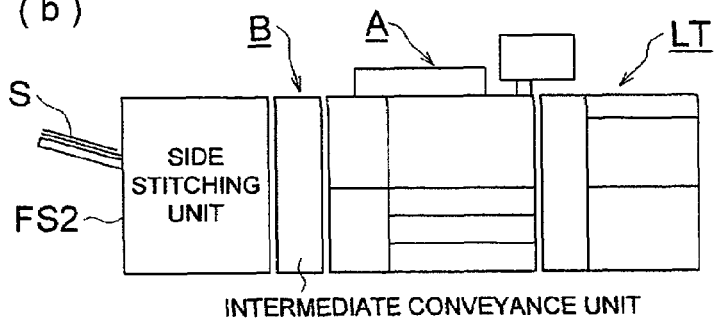
Figure 17:
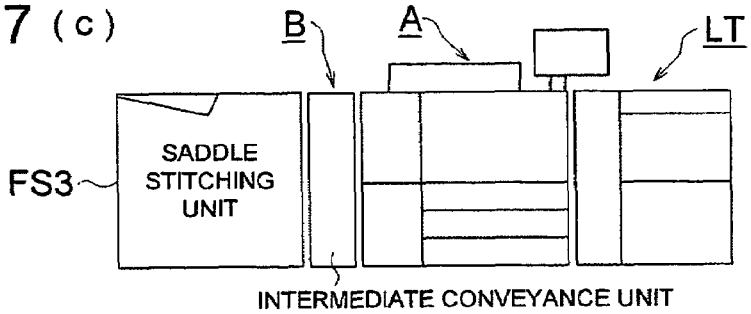
Figure 17:
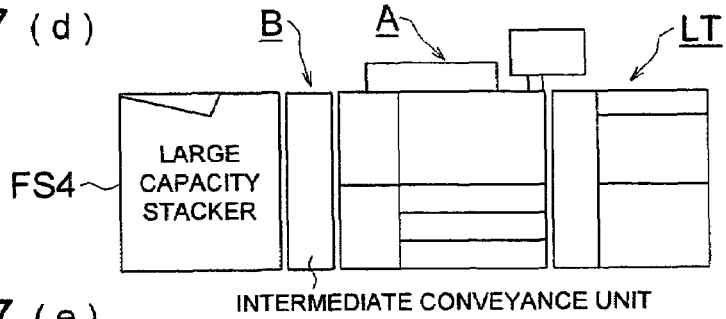
Figure 17:
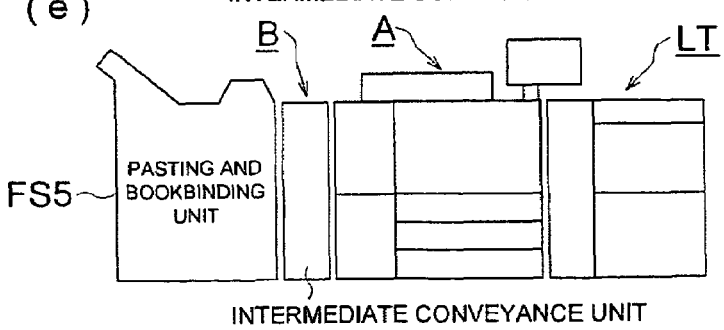

FIG. 17 is a pattern diagram of an image forming apparatus to which image forming apparatus body A being connected with large capacity sheet supply apparatus LT, intermediate conveyance unit B and each type of post-processing apparatus are connected.

FIG. 17 (*a*) shows an image forming apparatus wherein hole-punching and folding unit FS1 is connected to a sheet ejection section of image forming apparatus body A through intermediate conveyance unit B.

FIG. 17 (*b*) shows an image forming apparatus wherein side stitching unit FS2 is connected to a sheet ejection section of image forming apparatus body A through intermediate conveyance unit B.

FIG. 17 (*c*) shows an image forming apparatus wherein saddle stitching unit FS3 is connected to a sheet ejection section of image forming apparatus body A through intermediate conveyance unit B.

FIG. 17 (*d*) shows an image forming apparatus wherein large capacity stacker FS4 is connected to a sheet ejection section of image forming apparatus body A through intermediate conveyance unit B.

FIG. 17 (*e*) shows an image forming apparatus wherein pasting and bookbinding unit FS5 is connected to a sheet ejection section of image forming apparatus body A through intermediate conveyance unit B.

The intermediate conveyance unit B receives sheet S ejected from image forming apparatus body A one by one, and after two or more sheets S are stored in sheet storing section, two or more of sheets S are superposed and ejected to succeeding various types of post-processing apparatuses FS1-FS5, and by receiving two or more superposed sheets S simultaneously in the succeeding various types of post-processing apparatuses FS1-FS5, staying time in the course of post-processing can be shortened more than in the occasion where a sheet is received one by one. Owing to this, in the succeeding various types of post-processing apparatuses FS1-FS5, efficiency of post-processing can be enhanced while securing post-processing linear speed in the post-processing apparatus capable of conducting accurate post-processing, which is effective for productivity improvement of image forming apparatuses.

Figure 18:
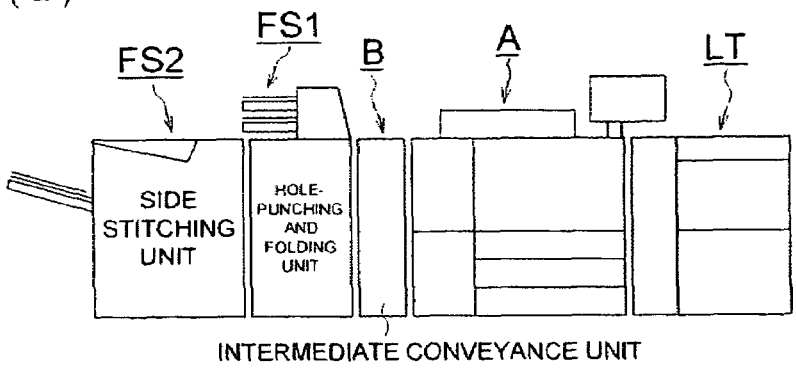
FIGS. 18(*a*)-18(*d*) show pattern diagrams of image forming apparatuses wherein plural post-processing apparatuses are connected to an image forming apparatus body through an intermediate conveyance unit.
Figure 18:
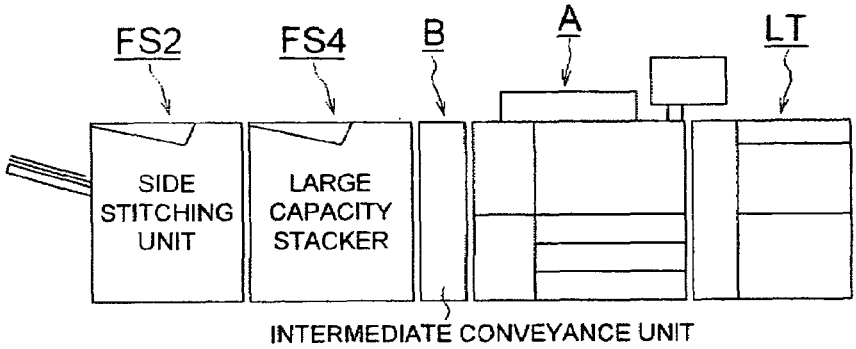
Figure 18:
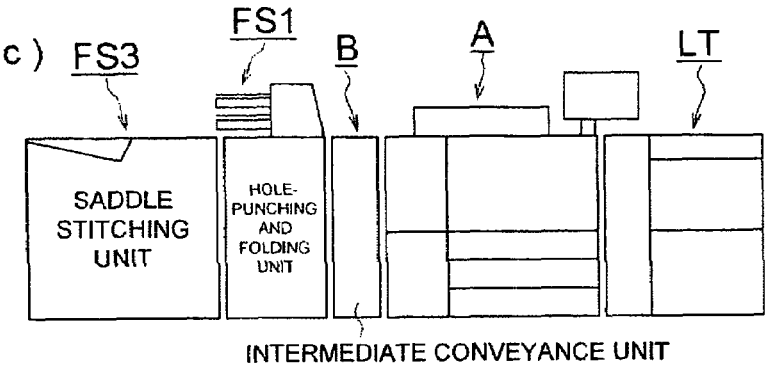
Figure 18:
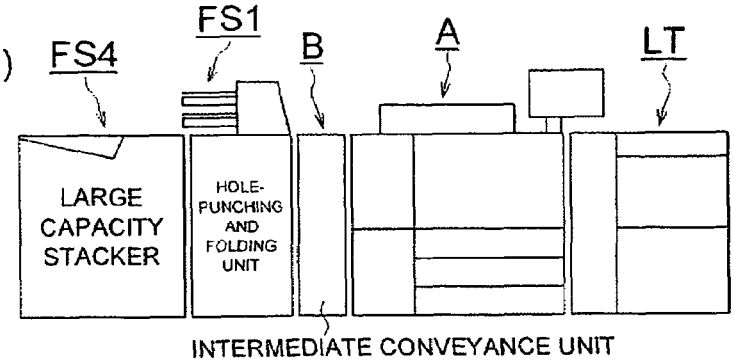

FIG. 18 shows pattern diagrams each being of an image forming apparatus wherein plural post-processing apparatuses are connected to image forming apparatus body A through intermediate conveyance unit B.

FIG. 18 (*a*) shows an image forming apparatus wherein hole-punching and folding unit FS1 and side stitching unit FS2 are connected to a sheet ejection section of image forming apparatus body A through intermediate conveyance unit B. In this apparatus, any one of hole-punching, folding and side stitching after conveyance of superposed sheets S and reversed conveyance can be selected to be practiced.

FIG. 18 (*b*) shows an image forming apparatus wherein large capacity stacker FS4 and side stitching unit FS2 are connected to a sheet ejection section of image forming apparatus body A through intermediate conveyance unit B. In this apparatus, either one of stacking of a large amount of sheets S and side stitching after conveyance of superposed sheets and reversed conveyance can be selected to be practiced.

FIG. 18 (*c*) shows an image forming apparatus wherein hole-punching and folding unit FS1 and saddle stitching unit FS3 are connected to a sheet ejection section of image forming apparatus body A through intermediate conveyance unit B. In this apparatus, any one processing of hole-punching, folding and saddle stitching after conveyance of superposed sheets and reversed conveyance can be selected to be practiced.

FIG. 18 (*d*) shows an image forming apparatus wherein hole-punching and folding unit FS1 and large capacity stacker FS4 are connected to a sheet ejection section of image forming apparatus body A through intermediate conveyance unit B. In this apparatus, any one processing of, hole-punching, folding and stacking of a large amount of sheets S after conveyance of superposed sheets S and reversed conveyance can be selected to be practiced.

The intermediate conveyance unit B receives sheet S ejected from image forming apparatus body A one by one, and after two or more sheets S are stored in sheet storing section, two or more of sheets S are superposed and ejected to succeeding plural types of post-processing apparatuses FS1-FS4, and by receiving two or more superposed sheets S simultaneously in the succeeding various types of post-processing apparatuses FS1-FS4, staying time in the course of post-processing can be shortened more than in the occasion where a sheet is received one by one. Owing to this, in the succeeding post-processing apparatuses FS1-FS4, efficiency of post-processing can be enhanced while securing post-processing linear speed in the post-processing apparatus capable of conducting accurate post-processing, which is effective for productivity improvement of image forming apparatuses.

Figure 19:
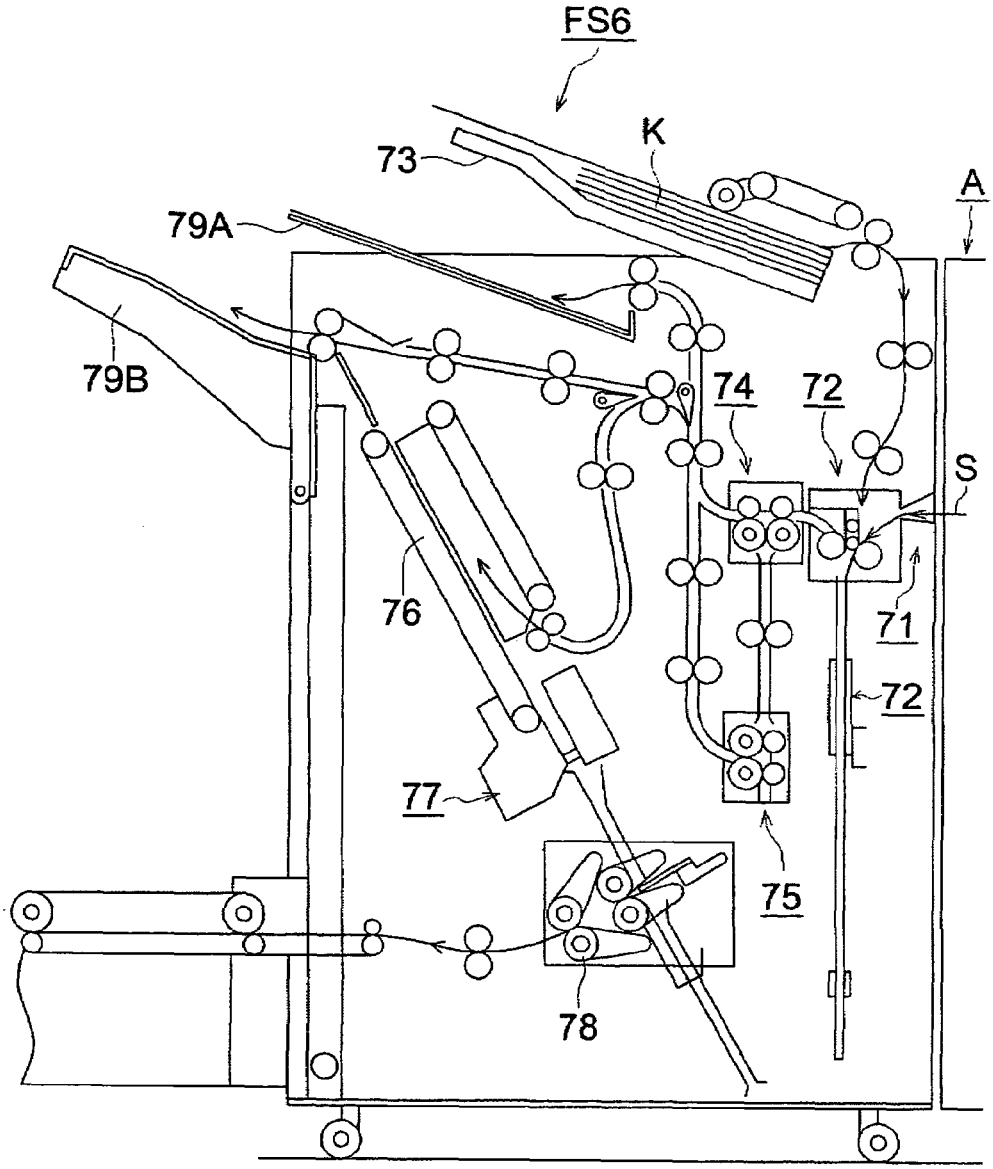
FIG. 19 is a structural diagram of a saddle stitching unit equipped with a sheet alignment unit.

FIG. 19 is a structural diagram of a saddle stitching unit (post-processing apparatus) FS6 equipped with a sheet alignment unit.

The saddle stitching unit FS6 has therein sheet introduction section 71 that receives sheet S on which an image is recorded, sheet alignment unit 72 having a feed-in section, a feed-out section and a reversing conveyance section, cover sheet supply unit 73, folding sections 74 and 75, intermediate stacker 76, stitching section 77, center folding section 78, fixed sheet ejection tray 79A, and rising and lowering sheet ejection tray 79B.

The sheet alignment unit 72 has the structure that is substantially the same as that of intermediate conveyance unit B, and it causes a leading edge of the sheet S conveyed into a sheet feed-in section to hit a stop member to be stopped, and causes also succeeding sheet S conveyed into a sheet feed-in section to hit the stop member in the same manner to be stopped to be superposed on preceding sheet S in a sheet feed-in section, and then, the sheet alignment unit raises the stop member and causes a trailing edge of plural sheets S to hit the aforesaid longitudinal alignment plate to be aligned, and retreats the longitudinal alignment plate from a sheet conveyance path of the feed-out section, for feeding out through the feed-out section.

By reversing and conveying after plural sheets S are loaded in a sheet storing section to be aligned as stated above, post-processing can be conducted without lowering the image processing speed of image forming apparatus body A.

Incidentally, though various types of post-processing apparatuses to be combined with image forming apparatus body A have been explained, in the embodiment of the invention, the invention can also be applied in the cases of post-processing apparatuses which are used after being connected to image forming apparatuses such as a quick printing press, a printer and a multifunctional machine. Further, various types of processing can be practiced as a post-processing apparatus in an individual form separated from image forming apparatus body A.

As stated above, the invention makes it possible to exhibit specific post-processing capabilities stably and surely, and in particular, it has been confirmed that the invention is effective for image forming apparatuses for quick printing field, thus, it has come to be possible that bookbinding operations of a print-on-demand mode to "make prints in necessary quantity of copies only when needed" can be carried out at high speed.

What is claimed is:

1. An image forming apparatus comprising:

an image forming apparatus body in which a sheet ejection linear speed is changeable;

at least one post-processing apparatus; and an intermediate conveyance unit positioned between the image forming apparatus body and the at least one post-processing apparatus, to both of which the intermediate conveyance unit is connected, the intermediate conveyance unit including:

(i) a sheet feed-in section which feeds sheets ejected from the image forming apparatus body into the intermediate conveyance unit one by one at a same speed as the sheet ejection linear speed of the image forming apparatus body;

(ii) a sheet storing section which stores at least two sheets that have been fed in by the sheet feed-in section, the sheet storing section including a sheet conveyance path; and (iii) a longitudinal alignment mechanism which aligns a sheet stored in the sheet storing section in a sheet longitudinal direction parallel to a conveyance direction of the sheet, the longitudinal alignment mechanism comprising:

a stop member which is hit by a leading edge in a feed-in direction of a sheet that has been fed into the sheet storing section, the stop member being movable along the sheet conveyance path;

a longitudinal alignment member which is hit by a trailing edge in a feed-in direction of a sheet that has been fed into the sheet storing section, the longitudinal alignment member being able to retreat from the sheet conveyance path; and paired feed-out rollers separable from each other and located on the sheet conveyance path between the stop member and the longitudinal alignment member;

wherein the intermediate conveyance unit further includes a sheet feed-out section which feeds the at least two sheets stored in the sheet storing section out of the intermediate conveyance unit with the sheets superimposed on each other at a same speed as a receiving linear speed of the at least one post-processing apparatus; and wherein the image forming apparatus further comprises a control section which controls the longitudinal alignment mechanism such that the stop member is moved toward the longitudinal alignment member with the paired feed-out rollers separated from each other after a plurality of sheets are stored in the sheet storing section so as to make trailing edges in the feed-in direction of the plurality of sheets stored in the sheet storing section hit the longitudinal alignment member, and so that the plurality of sheets are nipped by the paired feed-out rollers and fed out by a driving rotation of the paired feed-out rollers while being superimposed on each other after the longitudinal alignment member has been retreated from the sheet conveyance path.

2. The image forming apparatus of claim 1, wherein the intermediate conveyance unit comprises a lateral alignment mechanism which aligns a sheet stored in the sheet storing section in a sheet width direction perpendicular to the conveyance direction of the sheet.

3. The image forming apparatus of claim 1, wherein the sheet storing section of the intermediate conveyance unit is formed to extend substantially in a vertical direction.

4. The image forming apparatus of claim 1, wherein the intermediate conveyance unit comprises a sheet reversing section which reverses at least two sheets superposed on each other and fed out from the sheet storing section.

5. The image forming apparatus of claim 1, wherein the sheet storing section of the intermediate conveyance unit is formed to extend substantially in a vertical direction and feeds a sheet in from above and feeds the sheet out upward with the stop member being movable vertically along the sheet conveyance path.

6. The image forming apparatus of claim 5, wherein the intermediate conveyance unit comprises:

a sheet feed-in path leading to the sheet storing section;

a sheet feed-out path leading from the sheet storing section; and a conveyance path switching member for switching between the sheet feed-in path and the sheet feed-out path.

7. The image forming apparatus of claim 6, wherein one of the paired feed-out rollers of the intermediate conveyance unit is provided on the conveyance path switching member so that switching control of the conveyance path switching member by the control section makes the paired feed-out rollers come in contact with each other and separate from each other.

8. The image forming apparatus of claim 7, wherein the control section controls so that the stop member is positioned at an initial position when a preceding sheet is fed into the sheet storing section, and the stop member is moved toward the longitudinal alignment member to a first position to ensure that a trailing edge in a feed-in direction of the preceding sheet passes an edge part of the conveyance path switching member and is located on a side of the sheet feed-out path after the preceding sheet is stored in the sheet storing section, and then, the stop member is moved back to the initial position during a process of feeding a succeeding sheet into the sheet storing section.

9. The image forming apparatus of claim 1, wherein the at least one post-processing apparatus is a hole-punching and folding unit for applying hole-punching or folding to at least two sheets superposed on each other simultaneously.

10. The image forming apparatus of claim 1, wherein the at least one post-processing apparatus is a side stitching unit for applying stitching in a vicinity of a side of a bundle of a plurality of sheets.

11. The image forming apparatus of claim 1, wherein the at least one post-processing apparatus is a saddle stitching unit for applying saddle stitching and center folding to a bundle of a plurality of sheets.

12. The image forming apparatus of claim 1, wherein the at least one post-processing apparatus is a pasting and bookbinding unit for pasting on a spine portion of a bundle of a plurality of sheets.

13. The image forming apparatus of claim 1, wherein the at least one post-processing apparatus is a large capacity stacker capable of stacking and storing a large amount of sheets therein.

14. An intermediate conveyance unit which is connectable to an image forming apparatus body, in which a sheet ejection linear speed is changeable, and a post-processing apparatus between which the intermediate conveyance unit is interposed, the intermediate conveyance unit comprising:

a communication section which receives information related to the sheet ejection linear speed from the image forming apparatus body;

a sheet feed-in section which feeds sheets ejected from the image forming apparatus body into the intermediate conveyance unit one by one at a same speed as the sheet ejection linear speed of the image forming apparatus body based on the information received by the communication section;

a sheet storing section which stores at least two sheets that have been fed in by the sheet feed-in section, the sheet storing section including a sheet conveyance path; and a longitudinal alignment mechanism which aligns a sheet stored in the sheet storing section in a sheet longitudinal direction parallel to a conveyance direction of the sheet, the longitudinal alignment mechanism comprising:

a stop member which is hit by a leading edge in a feed-in direction of a sheet that has been fed into the sheet storing section, the stop member being movable along the sheet conveyance path;

a longitudinal alignment member which is hit by a trailing edge in a feed-in direction of a sheet that has been fed into the sheet storing section, the longitudinal alignment member being able to retreat from the sheet conveyance path; and paired feed-out rollers separable from each other and located on the sheet conveyance path between the stop member and the longitudinal alignment member;

wherein the intermediate conveyance unit further includes a sheet feed-out section which feeds the at least two sheets stored in the sheet storing section out of the intermediate conveyance unit with the sheets superimposed on each other at a same speed as a receiving linear speed of the at least on post-processing apparatus; and wherein the stop member is moved toward the longitudinal alignment member with the paired feed-out rollers separated from each other after a plurality of sheets are stored in the sheet storing section so as to make trailing edges in the feed-in direction of the plurality of sheets stored in the sheet storing section hit the longitudinal alignment member, and so that the plurality of sheets are nipped by the paired feed-out rollers and fed out by a driving rotation of the paired feed-out rollers while being superimposed on each other after the longitudinal alignment member has been retreated from the sheet conveyance path.

* * * * *

UNITED STATES PATENT AND TRADEMARK OFFICE

CERTIFICATE OF CORRECTION

PATENT NO. : 7,613,422 B2
APPLICATION NO. : 11/501526
DATED : November 3, 2009
INVENTOR(S) : Shida et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 418 days.

Signed and Sealed this

Nineteenth Day of October, 2010

David J. Kappos

David J. Kappos
*Director of the United States Patent and Trademark Office*